US010098446B2

(12) United States Patent
Telwar Kaicker et al.

(10) Patent No.: US 10,098,446 B2
(45) **Date of Patent: *Oct. 16, 2018**

(54) DUAL SIDED COSMETICS BRUSH AND METHODS FOR MAKING SAME

(71) Applicant: ANISA INTERNATIONAL, INC., Atlanta, GA (US)

(72) Inventors: Anisa Telwar Kaicker, Atlanta, GA (US); Kyoung Ae Jang, Atlanta, GA (US)

(73) Assignee: Anisa International, Inc., Atlanta, GA (US)

( * ) Notice: Subject to any disclaimer, the term of this patent is extended or adjusted under 35 U.S.C. 154(b) by 307 days.

This patent is subject to a terminal disclaimer.

(21) Appl. No.: 14/744,254

(22) Filed: Jun. 19, 2015

(65) Prior Publication Data

US 2016/0037901 A1 Feb. 11, 2016

Related U.S. Application Data

(63) Continuation of application No. 13/552,013, filed on Jul. 18, 2012, now Pat. No. 9,089,200, which is a (Continued)

(51) Int. Cl.
*A46B 3/08* (2006.01)
*A46B 9/02* (2006.01)

(Continued)

(52) U.S. Cl.
CPC ..... *A46B 7/023* (2013.01); *A45D 33/36* (2013.01); *A45D 40/262* (2013.01); *A46B 3/08* (2013.01);

(Continued)

(58) Field of Classification Search
CPC ..... A45D 40/262; A46B 3/08; A46B 9/021; A46B 9/06
See application file for complete search history.

(56) References Cited

U.S. PATENT DOCUMENTS 3,072,944 A 1/1963 Clayton
4,483,036 A 11/1984 Sayklay (Continued)

FOREIGN PATENT DOCUMENTS

JP 61-47917 U 3/1986
JP 81-47917 3/1986

(Continued)

OTHER PUBLICATIONS

International Searching Authority, International Search Report for International Application No. PCT/US2009/004449, dated Mar. 22, 2010, 2 pages, Korean Intellectual Property Office, Republic of Korea.

(Continued)

*Primary Examiner* — Randall Chin
(74) *Attorney, Agent, or Firm* — Taylor English Duma LLP

(57) ABSTRACT

A two-component brush and methods of providing same, including a method in which first and second bristle portion are each separately glued together at the base, and then the bases are cut into "A" and "B" section, and the "A" section of the first bristle portion is combined with the "B" section of the second bristle portion. Also included is a method which includes the use of a two-section mold into which first and second bristle portions are placed into first and second mold portions, and the first and second bristle portions are fixed together before being removed. Also included is a dual sided retractable configuration.

4 Claims, 20 Drawing Sheets

Brush 10

Related U.S. Application Data continuation-in-part of application No. 12/462,681, filed on Aug. 7, 2009, now Pat. No. 8,256,058.

(60) Provisional application No. 61/188,754, filed on Aug. 12, 2008, provisional application No. 61/552,014, filed on Oct. 27, 2011.

(51) Int. Cl.

| | |
|---|---|
| ***A46B 9/06*** | (2006.01) |
| ***A45D 40/26*** | (2006.01) |
| ***A46B 7/02*** | (2006.01) |
| ***A46D 3/00*** | (2006.01) |
| ***A46D 1/04*** | (2006.01) |
| ***A46D 1/00*** | (2006.01) |
| ***A45D 33/36*** | (2006.01) |

(52) U.S. Cl.

CPC ..... *A46B 9/021* (2013.01); *A46B 9/06* (2013.01); *A46D 1/00* (2013.01); *A46D 1/0207* (2013.01); *A46D 1/04* (2013.01); *A46D 3/00* (2013.01); *A46B 2200/1046* (2013.01)

(56) References Cited

U.S. PATENT DOCUMENTS

| | | | |
|---|---|---|---|
| 4,610,045 | A | 9/1986 | Rauch |
| 4,756,039 | A | 7/1988 | Pardo |
| 4,998,315 | A | 3/1991 | Pessis |
| 5,220,702 | A | 6/1993 | Howell et al. |
| 5,507,063 | A | 4/1996 | Hirsch |
| 5,588,447 | A | 12/1996 | Gueret |
| 6,224,287 | B1 | 5/2001 | Gieux |
| 6,367,114 | B1 | 4/2002 | Babkowski |
| 6,513,183 | B2 | 2/2003 | Dorf |
| 7,159,950 | B2 | 1/2007 | Young-Chul |
| 2002/0078902 | A1 | 6/2002 | Ehrmann |
| 2003/0182750 | A1 | 10/2003 | Nishida et al. |
| 2007/0177930 | A1 | 8/2007 | Byun |
| 2008/0141479 | A1 | 6/2008 | Mink |
| 2008/0169002 | A1 | 7/2008 | Hwang |
| 2011/0185528 | A1 | 8/2011 | Befve et al. |
| 2017/0208932 | A1* | 7/2017 | Ajootian ..... A46B 9/06 |

FOREIGN PATENT DOCUMENTS

| | | |
|---|---|---|
| JP | 06-209823 | 8/1994 |
| JP | 2006/075329 A | 3/2006 |
| JP | 2008/168108 A | 7/2008 |

OTHER PUBLICATIONS

International Searching Authority, Written Opinion for International Application No. PCT/US2009/004449, dated Mar. 22, 2010, 4 pages, Korean Intellectual Property Office, Republic of Korea.

International Preliminary Examining Authority, Patent Cooperation Treaty International Preliminary Report on Patentability for International Application No. PCT/US2009/004449, dated Dec. 13, 2010, 6 pages, Korean Intellectual Property Office, Republic of Korea.

Australian Patent Office, Examiner's First Report on Patent Application No. 2009282461, dated Jan. 17, 2012, 2 pages, IP Australia, Australia.

European Patent Office (EPO) Official action in EPO appn 09806937.0-1659 / 2315539 PCT/US2009004449, dated May 22, 2014.

Japan Patent Office, Notice of Reason for Rejection for Application No. 2011-522968, dated Jan. 29, 2013, 11 pages, Japan.

State Intellectual Property Office of the People's Republic of China, Second Office Action for Application No. 200980131626.3, dated May 13, 2013, 11 pages, China.

* cited by examiner

Brush 10

STEP 6A

STEP 7A

STEP 8A

STEP 9A

Step 11A - Put head bristles down into tooling (not shown) so knife can cut down and cut the glued base into half (cuts part or all of ring mold as well)

Synthetic Fibers 120 separated into two slices 128a and 128b
Natural Fibers 130 separated into two slices 138a and 138b STEP 13A - Creation of Dual sided Brush Head 110

STEP 14A

STEP 15A

STEP 16A

STEP 7B

STEP 8B

STEP 9B

STEPS 10B AND 11B

STEP 12B

STEP 13B

One brush
portion extended

Both brush
portions extended

Alternate method for separating bristle slices after glue is applied to base - First remove ring mold 240, then cut glued base 123 in two.

DUAL SIDED COSMETICS BRUSH AND METHODS FOR MAKING SAME

CROSS-REFERENCE TO RELATED APPLICATIONS

The present application is a continuation of and claims all benefit and priority to U.S. patent application Ser. No. 13/552,013, filed Jul. 18, 2012, which itself is a continuation-in-part of and claims all benefit and priority to U.S. patent application Ser. No. 12/462,681, filed Aug. 7, 2009. U.S. patent application Ser. No. 12/462,681, filed Aug. 7, 2009, also claims the benefit of U.S. Provisional Patent Application No. 61/188,754, filed on Aug. 12, 2008. U.S. patent application Ser. No. 13/552,013, filed Jul. 18, 2012, also claims the benefit of U.S. Provisional Patent Application No. 61/552,014, filed on Oct. 27, 2011. All of the above-referenced applications are incorporated herein by reference in their entireties.

BACKGROUND

Cosmetic brushes are the main applicators for people applying makeup. Different sorts of makeup require different brushes such as a lip brush, an eye shadow brush etc. In cosmetic applicators currently commercially available, one brush has only one function, so the user needs to buy a set of brushes to achieve a satisfactory makeup application.

In other fields, brushes with more than one set of bristles have been proposed. The bristles typically project sideways from a head end of a handle, in opposite directions, so that either set of bristles can be used without involving the other set. However, this is unsuitable for many cosmetic applications, where a brush with the bristles extending endways from the handle is preferred.

SUMMARY

In accordance with an embodiment of the present invention, there is provided a brush having a handle and a head. The head comprises bristles extending endways from an end of the handle. Different sides of the brush head have different properties.

In accordance with another embodiment of the invention, there is provided a brush head comprising bristles all extending in the same general direction. The brush head comprises two sides in which the bristles have different properties The brush head may be generally circular, with two generally semicircular sides having different properties.

The different properties may be provided by using different fibers for the bristles. In general, a "fiber" includes anything that can be used for the bristles of a brush suitable for applying cosmetics, skin care products, or the like.

The two sides may be, for example, one stiffer than the other. The two sides may use bristles of different thicknesses. The two sides may use bristles of different materials, such as a natural bristle and a synthetic bristle. The materials may be a material with greater affinity for a cosmetic that is to be applied, for transferring the cosmetic to the skin of the user, and a material with lesser affinity for the cosmetic, for blending the applied cosmetic on the skin The bristles on the two sides of the brush may be different colors, providing both an esthetically interesting appearance and an easy way for a user to distinguish which side is which It is preferred in most cases for the brush head to be fairly sharply divided into the two sides. However, the two sides may blur into each other to some extent, either to provide transitional or intermediate properties, or because of the practicalities of manufacture It is preferred in most cases for the sides of the brush head to be roughly equal halves. However, one side may alternatively be larger than the other, either as major and minor sectors, separated by two radii, or as major and minor segments separated by a chord, or divided in some other way.

One aspect of the concepts described herein includes a method of manufacturing a brush having an application end defining a predetermined brush application tip profile, said method including the use of first and second bristle portions, each of said bristle portions being comprised of a plurality of elongate flexible bristles being substantially aligned along their lengths, each of said bristle portions having two opposing ends, one end being an application end and the other end being a securing end, said brush having said method comprising the steps of: A) selecting first and second bristle portions, said first bristle portion having a first set of properties, and said second bristle portion having a second set of properties; B) placing said application end of said first bristle portion in a forming mold defining a cavity surface corresponding to said predetermined brush application tip profile; C) allowing said bristles within said first bristle portion to shift longitudinally relative to each other upon contact with said forming mold, such that said application end of first bristle portion tends to conform to said forming mold and said application end of said first bristle portion tends to approximate said predetermined brush application tip profile; D) fixing said bristles within said first bristle portion relative to each other such that said application end of said first bristle portion tends to approximate said predetermined brush application tip profile; E) trimming said securing end of said first bristle portion along a direction transverse to said bristles, such that said securing end of said first bristle portion defines a more flattened securing end; F) applying glue to said more flattened securing end of said first bristle portion such that a first glued base is provided sufficient to hold retain said application end of said first bristle portion so it approximates said predetermined brush application tip profile; G) slicing said first glued base of said first bristle portion along a plane being substantially parallel to the longitudinal axes of its bristles, such that said first bristle portion is split and separated into a first bristle "A" portion and a first bristle "B" portion; H) placing said application end of said second bristle portion in a forming mold defining a cavity corresponding to said predetermined brush application tip profile; I) allowing said bristles within said second bristle portion to shift longitudinally relative to each other upon contact with said forming mold, such that said application end of second bristle portion tends to conform to said forming mold and said application end of said second bristle portion tends to approximate said predetermined brush application tip profile; J) fixing said bristles within said second bristle portion relative to each other such that said application end of said second bristle portion tends to approximate said predetermined brush application tip profile; K) trimming said securing end of said second bristle portion along a direction transverse to said bristles, such that said securing end of said second bristle portion defines a more flattened securing end; L) applying glue to said more flattened securing end of said second bristle portion such that a second glued base is provided sufficient to hold retain said application end of said second bristle portion so it approximates said predetermined brush application tip profile; M) slicing said glued base of said second bristle portion in a direction along a plane being substantially parallel to the longitudinal axes of its bristles, such that said second bristle portion is split and separated into a second bristle "A" portion and a second bristle "B" portion; and N) attaching said first bristle "A" portion adjacent to said second bristle "B" portion such that their application ends tend to approximate said predetermined brush application tip profile.

Other aspects of the concepts herein relate to the above paragraph but further comprising: O) attaching said first bristle "B" portion adjacent to said second bristle "A" portion such that their application ends tend to approximate said predetermined brush application tip profile. Other aspects of the concepts herein relate to the above paragraph relate to slicing said first glued base by knife cut, and wherein the step of slicing said second glued base is performed by knife cut, the cuts being down the middle or to one side.

Other aspects include a method of manufacturing a brush having an application end defining a predetermined brush application tip profile, said method including the use of first and second bristle portions, each of said bristle portions being comprised of a plurality of elongate flexible bristles being substantially aligned along their lengths, each of said bristle portions having two opposing ends, one end being an application end and the other end being a securing end, said brush having said method comprising the steps of: A) selecting first and second bristle portions, said first bristle portion having a first set of properties, and said second bristle portion having a second set of properties; B) providing a forming mold defining a cavity surface corresponding to said predetermined brush application tip profile, said cavity surface defining a cavity, said cavity being separated into first and second cavity portions by a substantially planar dividing plate; C) placing said application end of said first bristle portion in said first cavity portion of said forming mold; D) allowing said bristles within said first bristle portion to shift longitudinally relative to each other upon contact with a first portion of said forming mold, such that said application end of first bristle portion tends to conform to said first portion of said forming mold, and said application end of said first bristle portion tends to approximate a first portion of said predetermined brush application tip profile; E) placing said application end of said second bristle portion in said second cavity portion of said forming mold, such that said substantially planar dividing plate is at least partially between some part of said first and second bristle portions; F) allowing said bristles within said second bristle portion to shift longitudinally relative to each other upon contact with a second portion of said forming mold, such that said application end of second bristle portion tends to conform to said second portion of said forming mold, and said application end of said second bristle portion tends to approximate a second portion of said predetermined brush application tip profile; G) fixing said bristles within said first bristle portion relative to said bristles within said second bristle portion such that said application end of said first bristle portion and said application end of said second bristle portion combine as a two-component bristle bundle having two opposing ends, one end being an application end and the other end being a securing end, such that said application end of said two-component bristle bundle tends to approximate said predetermined brush application tip profile; and H) removing said substantially planar dividing plate from between said first and second bristle portions.

Other aspects include a cosmetics brush assembly having two brush portions, the assembly comprising: A) a frame defining two cavity portions, namely a first cavity portion and a second cavity portion; B) a first subassembly including a first brush portion movable relative to the frame, the first brush portion movable from a first position in which the brush portion is substantially concealed within first cavity portion, to a second portion in which the brush portion is less concealed within first cavity portion than it was in the first position; and C) a first subassembly including a first brush portion movable relative to the frame, the first brush portion movable from a first position in which the brush portion is substantially concealed within first cavity portion, to a second portion in which the brush portion is less concealed within first cavity portion than it was in the first position.

Other aspects referenced in the originally filed claims of this application are also included.

It is to be understood that both the foregoing general description and the following detailed description are exemplary and explanatory and are intended to provide further explanation of the invention as claimed.

BRIEF DESCRIPTION OF THE DRAWINGS

Figure 1:
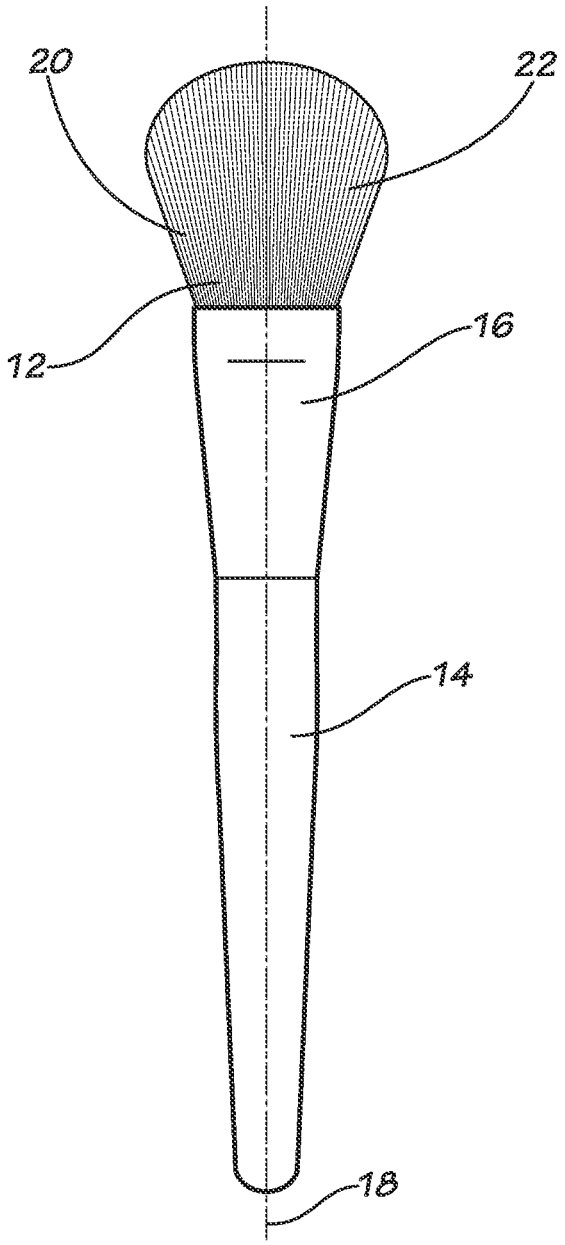

Having thus described the invention in general terms, reference will now be made to the accompanying drawings, which are not necessarily to scale.

In the drawings:

FIG. 1 is a side view of an embodiment of the brush 10 according to one embodiment of the invention, having an exemplary predetermined brush application tip profile.

Figure 2:
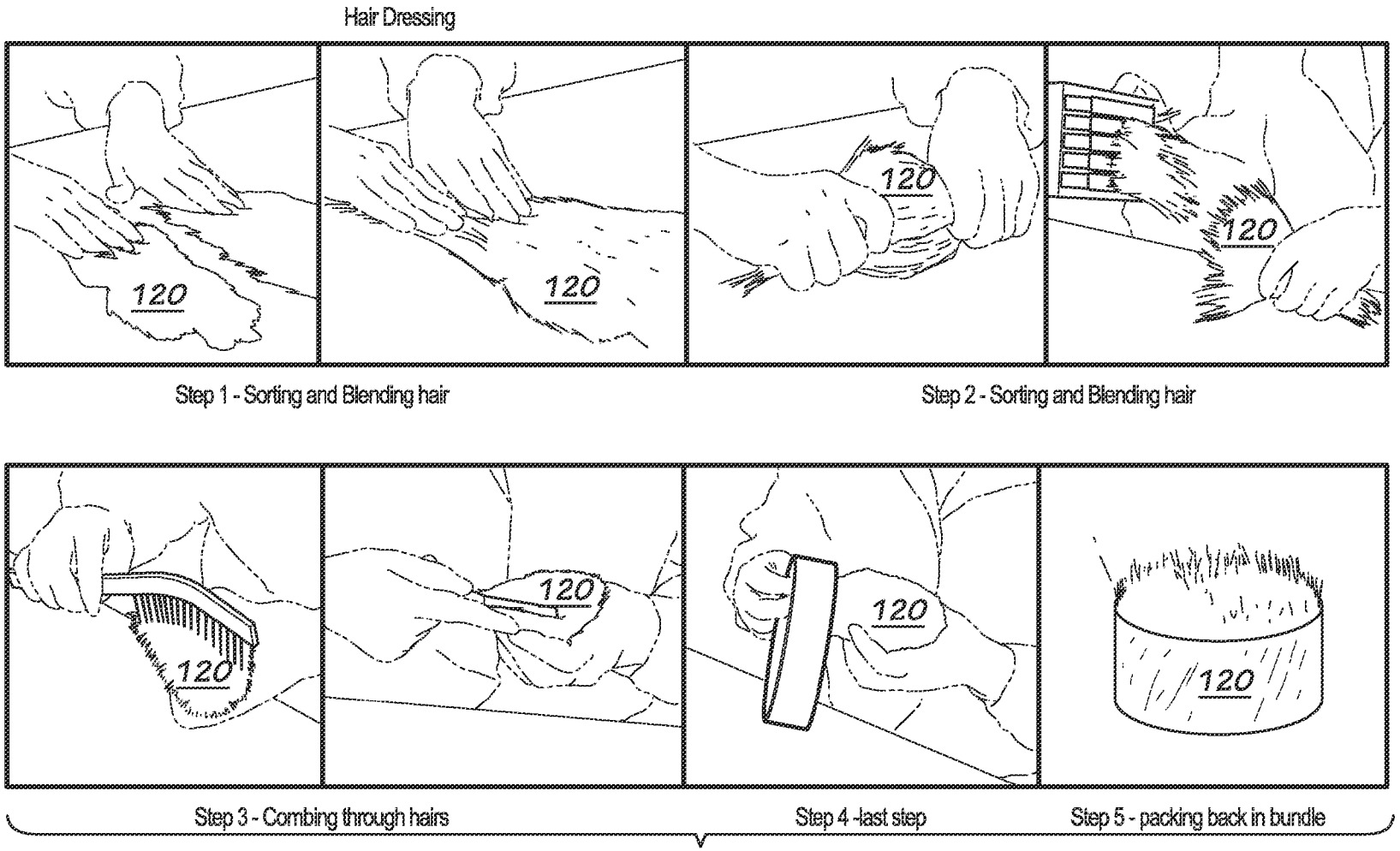

FIG. 2 depicts the preparation of brush hairs for the brush head manufacturing method of the present invention.

Figure 3:
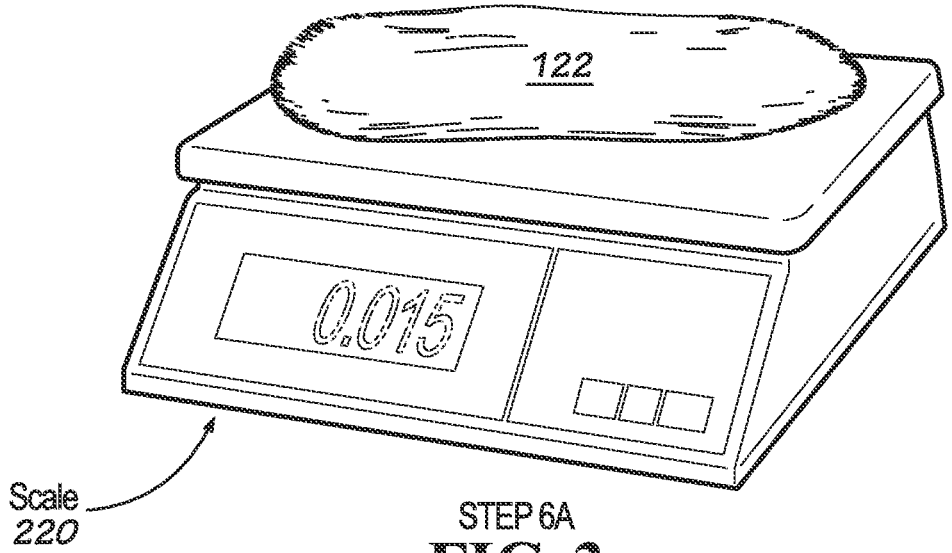

FIG. 3 shows Step 6A, in which a bundle 122 of brush hairs is pulled from the pack of synthetic fibers 120 (or similarly a bundle of brush hairs is pulled from the pack of natural fibers 130) and weighed on a scale 220.

Figure 4:
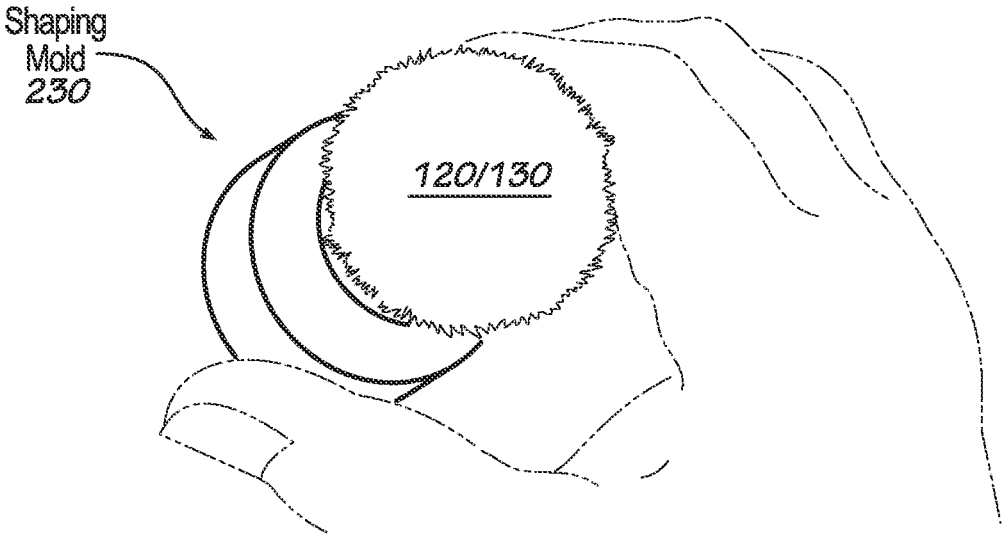

FIG. 4 shows the bundle 122 of brush hairs placed in a shaping mold 230.

Figure 5:
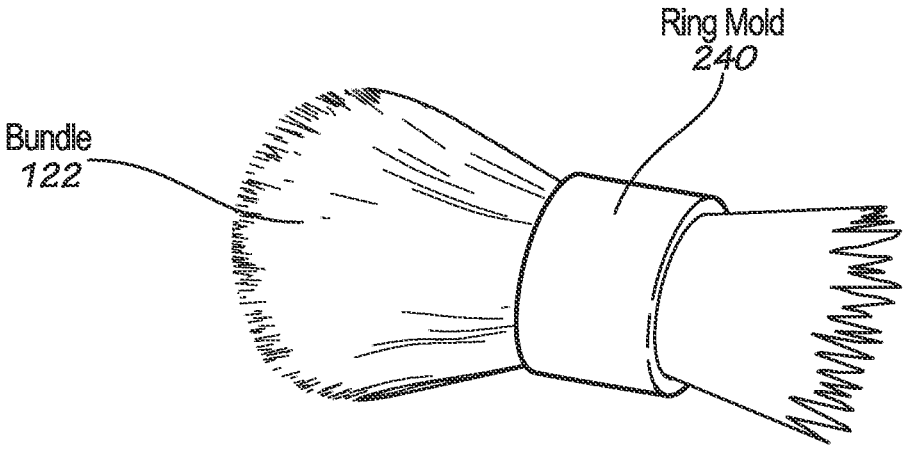

FIG. 5 shows a ring mold 240 is placed around the tail end of the bundle 122.

Figure 6:
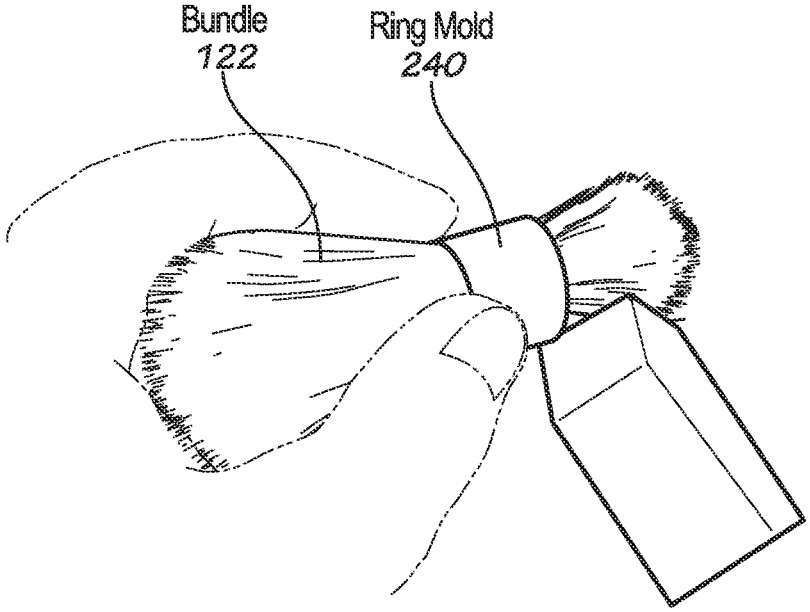

FIG. 6 shows the trimming of excess brush hair from the tail end of the bundle 122 while the ring mold 240 still holds the bundle 122 in place.

Figure 7:
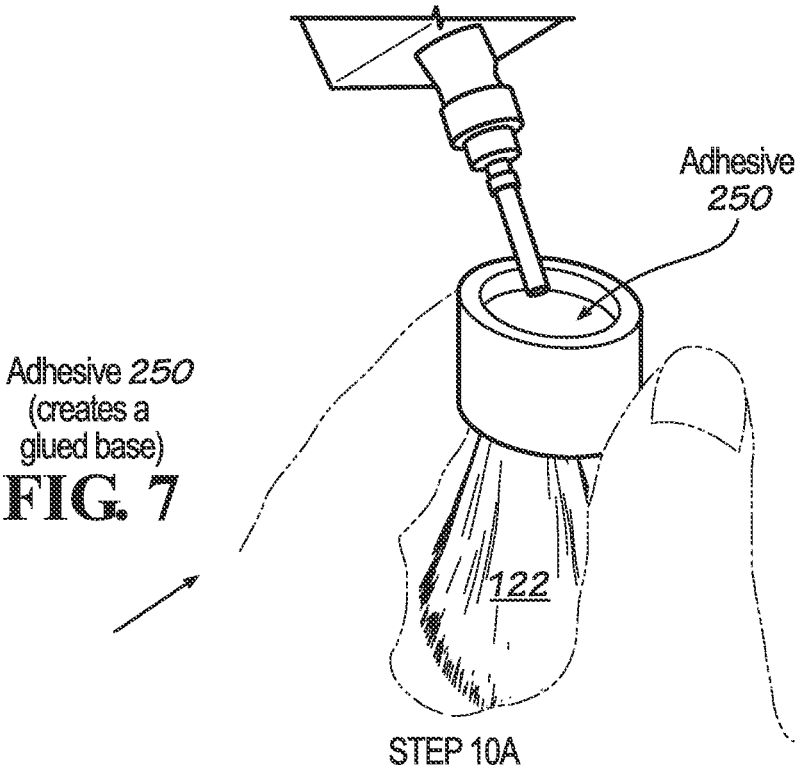

FIG. 7 shows a layer of adhesive 250 is injected into the base of the bundle 122 while it is held by the ring mold 240.

Figure 8:
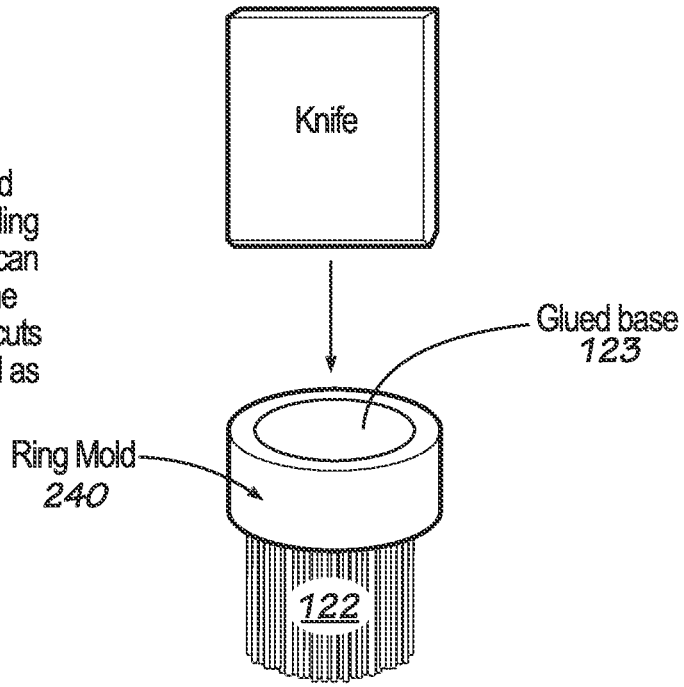

FIG. 8 shows a knife used to cut through the glued base, across the width of the ring mold 240. Slicing in this embodiment is done in a direction substantially parallel to the longitudinal axes of its bristles and along a plane being substantially parallel to the longitudinal axes of its bristles.

Figure 9:
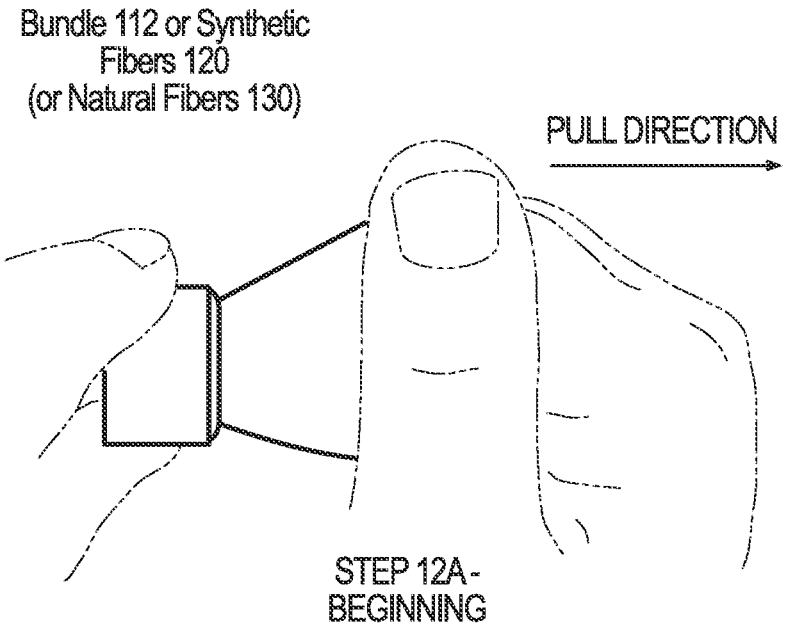

FIG. 9 shows the slices removed from the ring mold 240.

Figure 10:
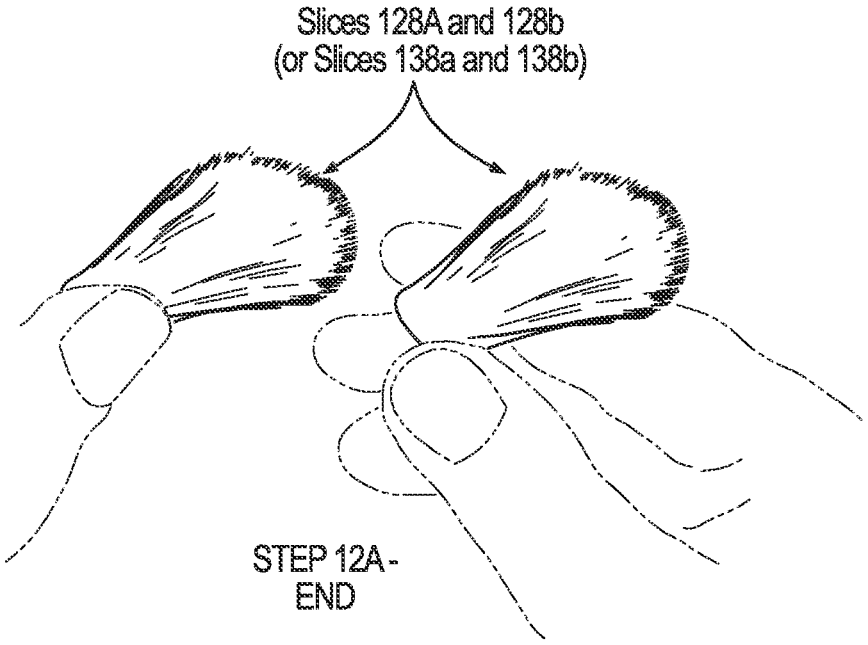

FIG. 10 shows the slices separated.

Figure 11:
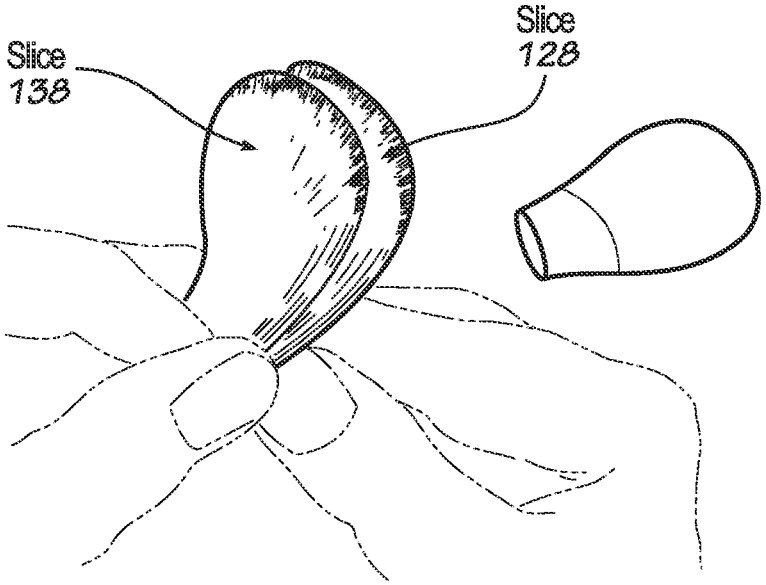

FIG. 11 shows a synthetic slice 128 and a natural slice 138 joined to create a dual sided brush head 110.

Figure 12:
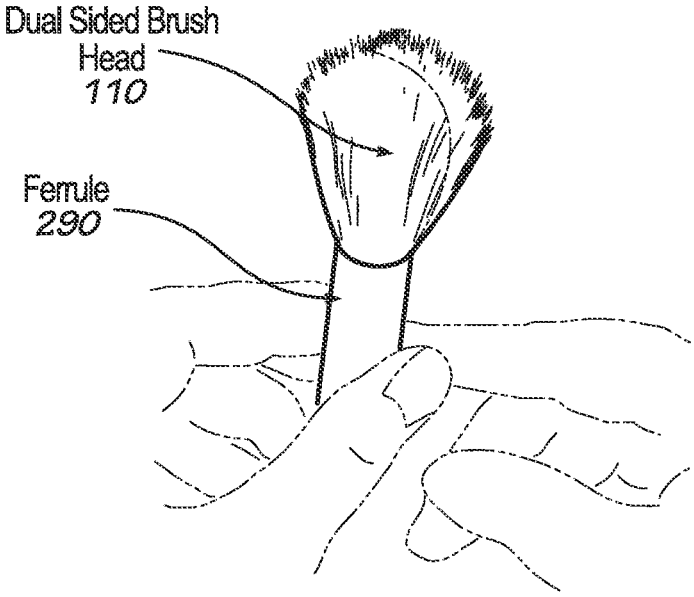

FIG. 12 shows the dual sided brush head 110 placed into an open end of a ferrule 290.

Figure 13:
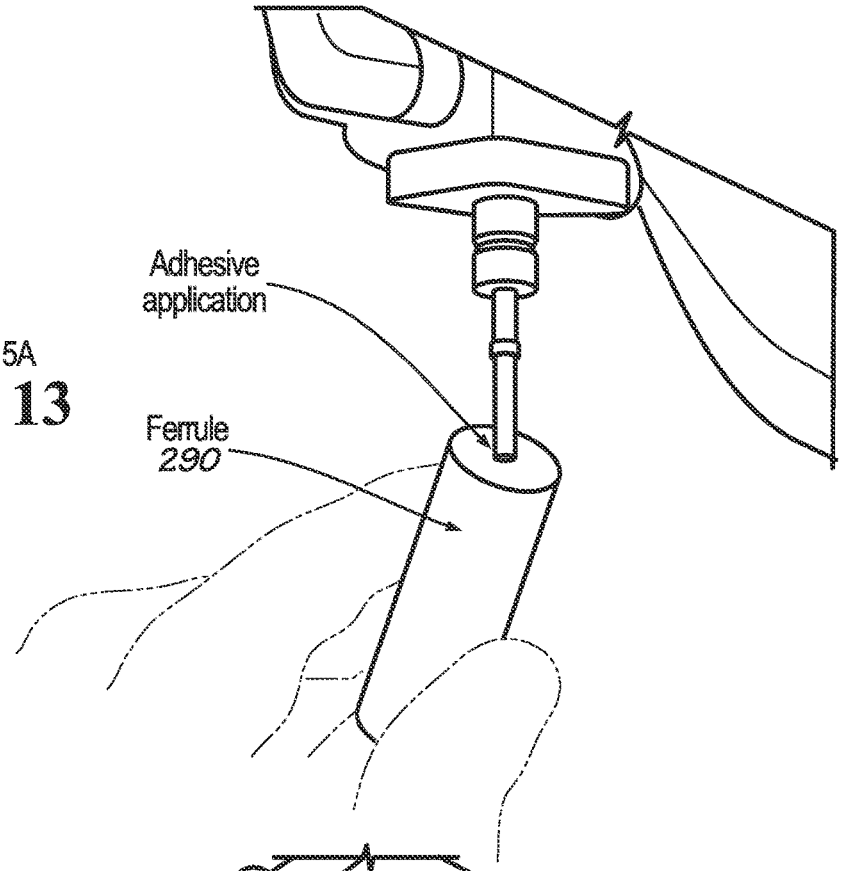

FIG. 13 shows an adhesive injected into the ferrule 290 to bond the dual sided brush head 110 inside the ferrule 290.

Figure 14:
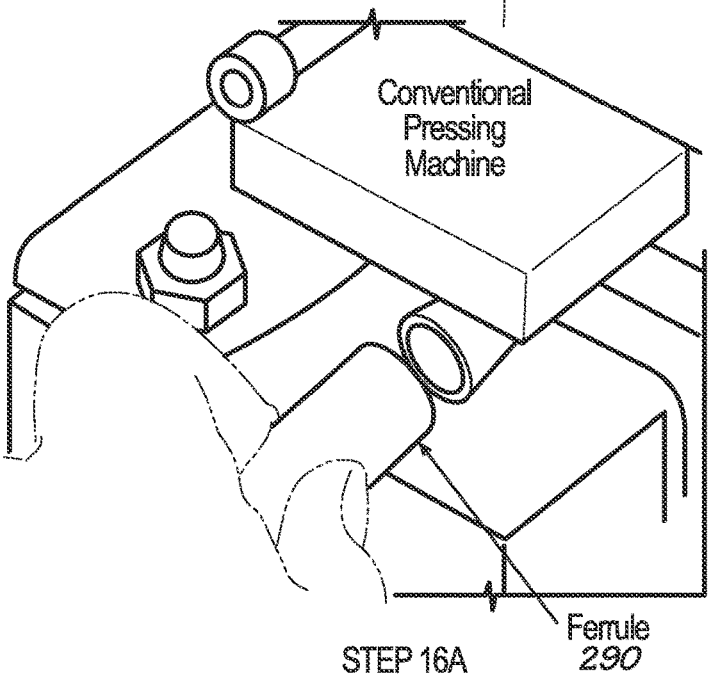

FIG. 14 shows the ferrule 290 pressed around the dual sided brush head 110, using a conventional pressing machine.

Figure 15:
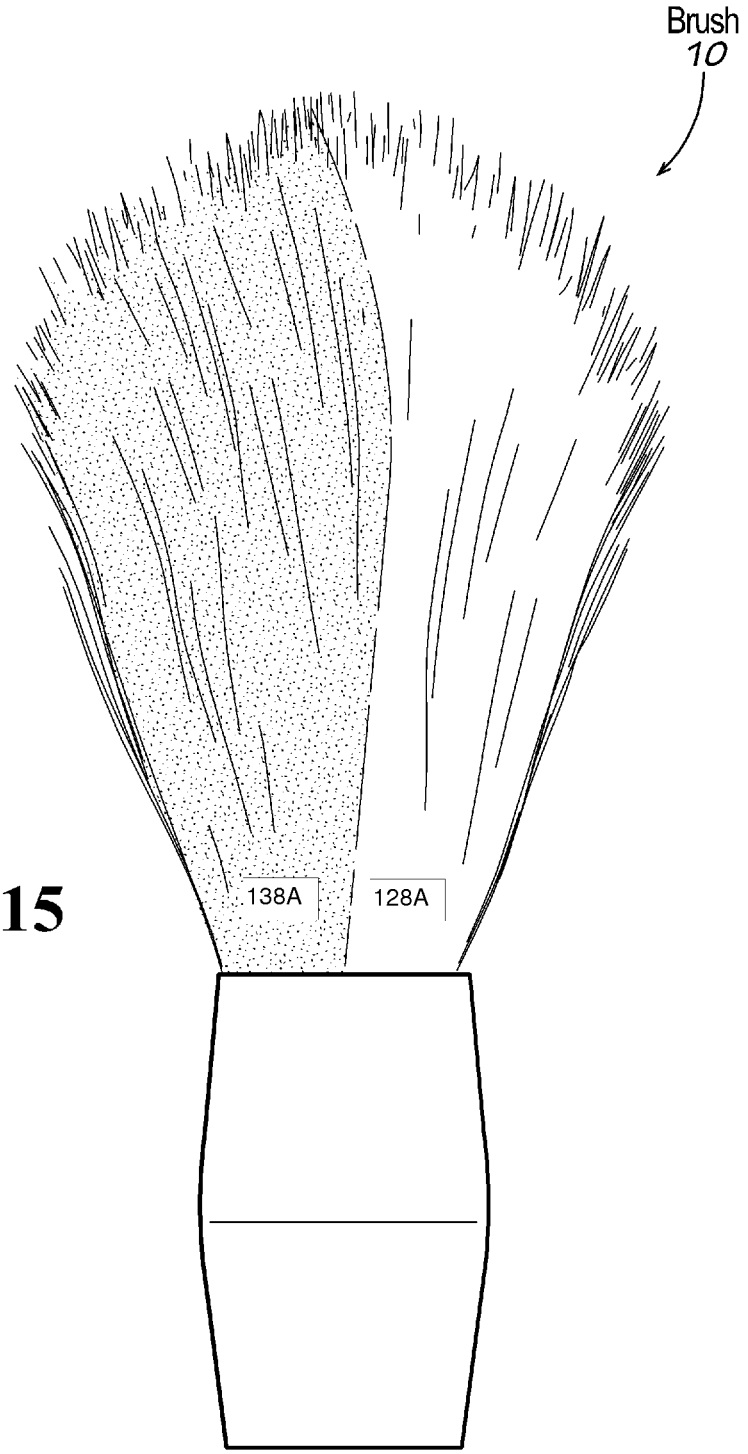

FIG. 15 shows a dual sided brush head 110 comprised of synthetic fibers 128*a* on one side, adjacent to natural fibers 138*a* on the other side, all within the same ferrule 290.

Figure 16:
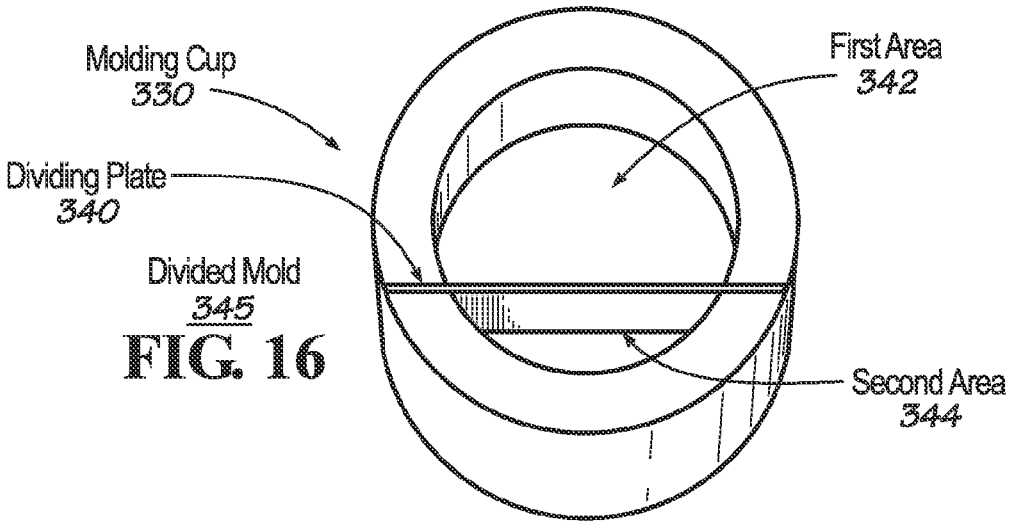

FIG. 16 shows the molding cup 330 with a base 344, the base surface of which in the present embodiment is sloped and/or arcuate, although other configurations may easily be provided.

Figure 17:
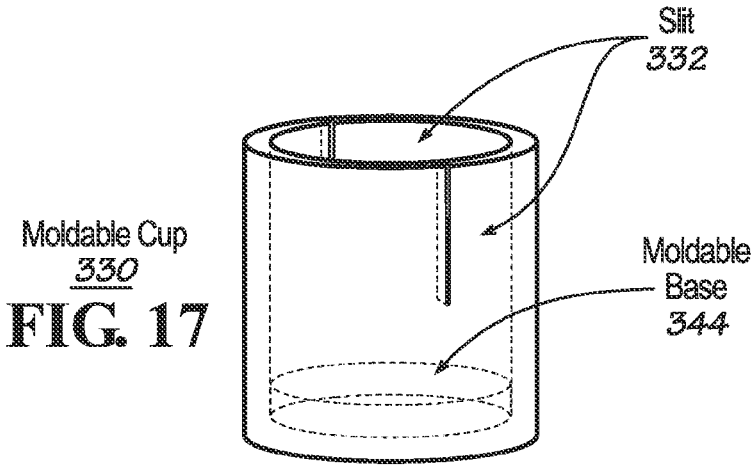

FIG. 17 shows a pair of slits 332 is cut into the wall of the molding cup 330.

Figures 18A, 18B:
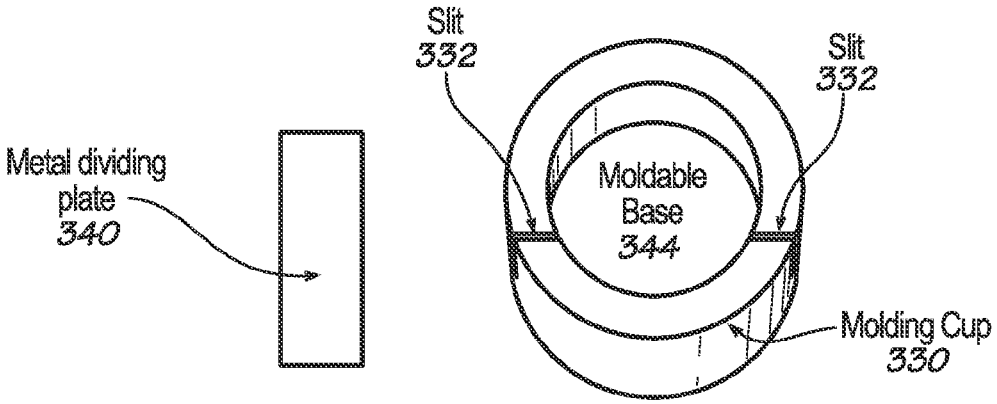

FIGS. 18A and 18B combine to show the metal plate 340 inserted into the slits 332 to define the first area 342 and the second area 344 of the divided mold 345.

Figure 19:
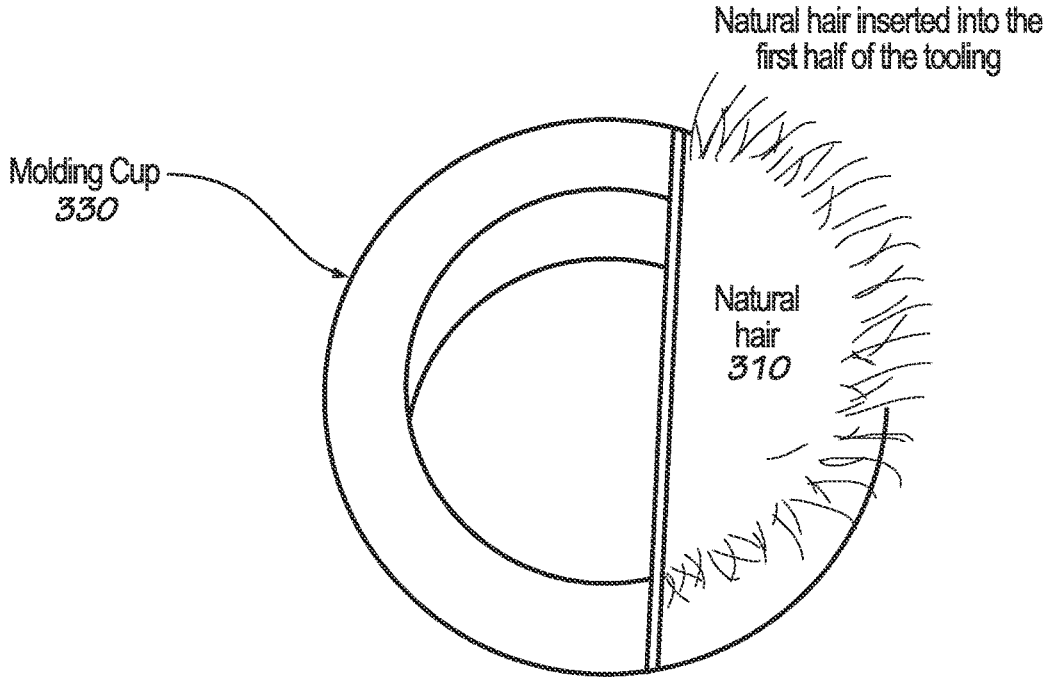

FIG. 19 shows natural hair 310 inserted into the first area 342 of the divided mold 345.

Figure 20:
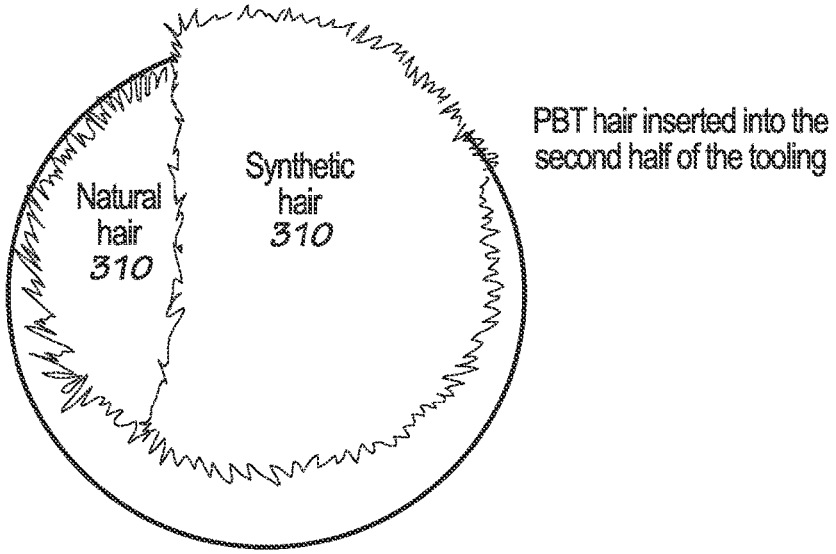

FIG. 20 shows synthetic hair 320 inserted into the second area 344 of the divided mold 345.

Figure 21:
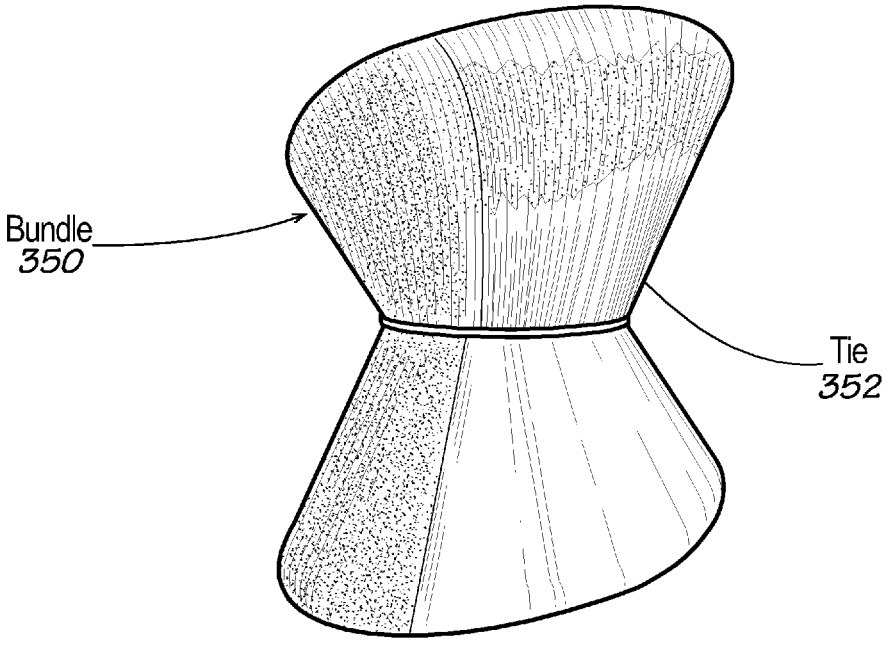

FIG. 21 shows the hairs 310 and 320 removed as a whole from the divided mold 345 and held together as a bundle 350 with a tie 352.

Figure 22:
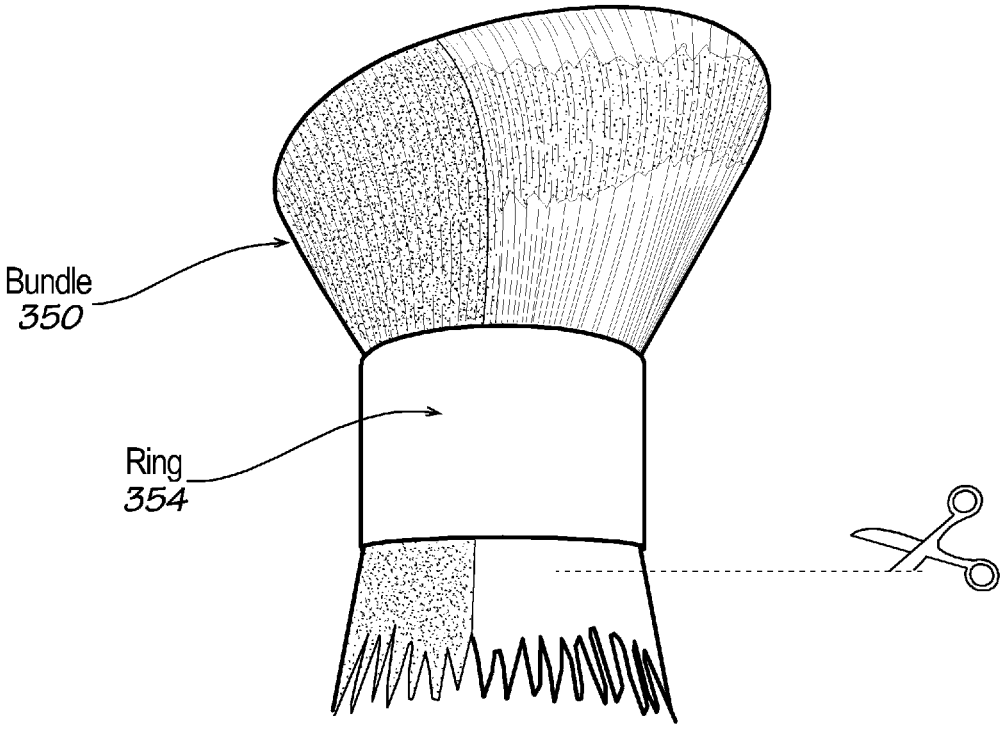

FIG. 22 shows the base of the bundle 350 inserted into a ring 354, which may be formed of polyethylene using conventional methods.

Figure 23:
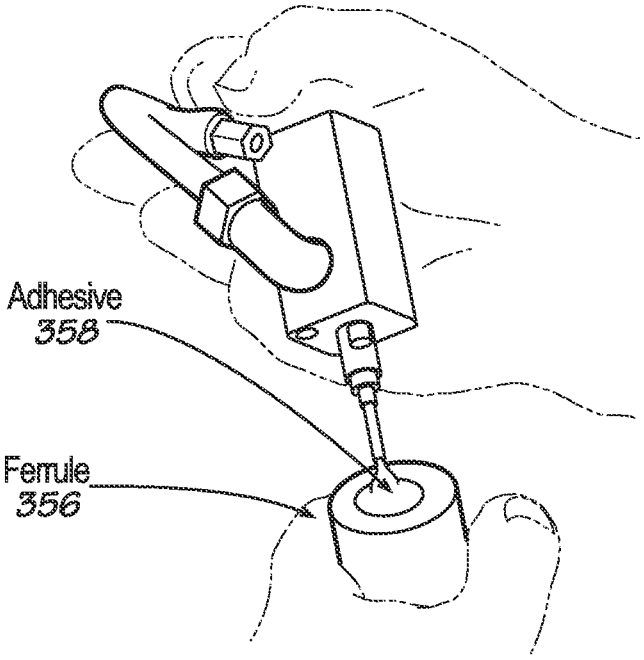

FIG. 23 shows an adhesive 358 injected into a ferrule 356.

Figure 24:
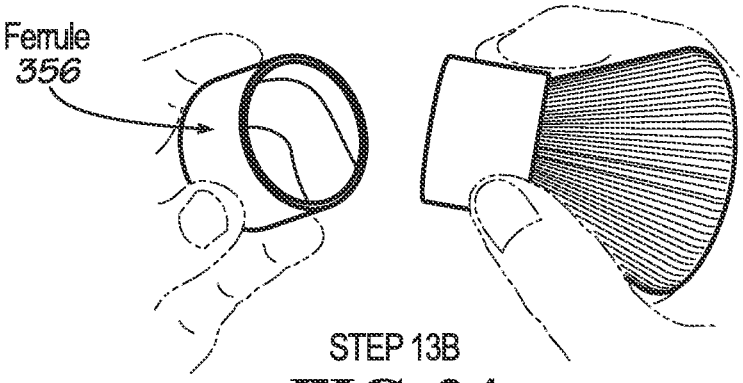

FIG. 24 shows the ring 354 inserted into the ferrule 356 (the unnumbered adhesive is shown inside), after which the adhesive is allowed to dry.

Figure 25:
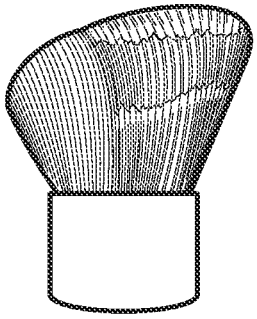

FIG. 25 shows an angled dual sided kabuki brush 400.

Figure 26:
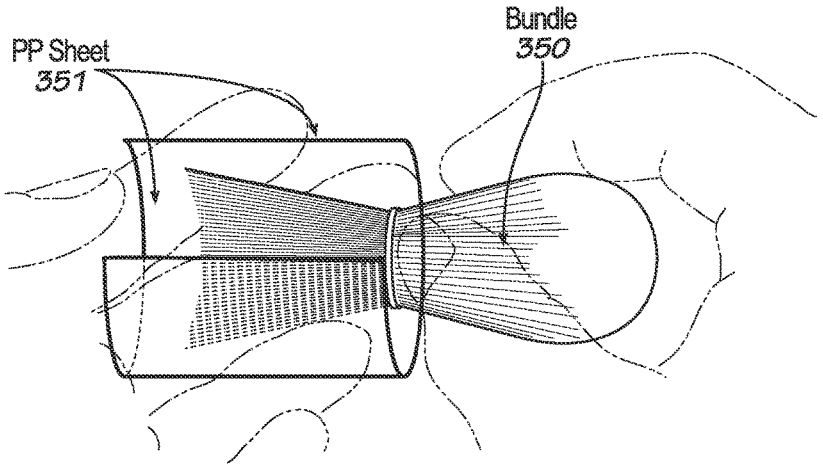

FIG. 26 shows a tied bundle 350 placed atop a polypropylene sheet 351 partially wrapped around it.

Figure 27:
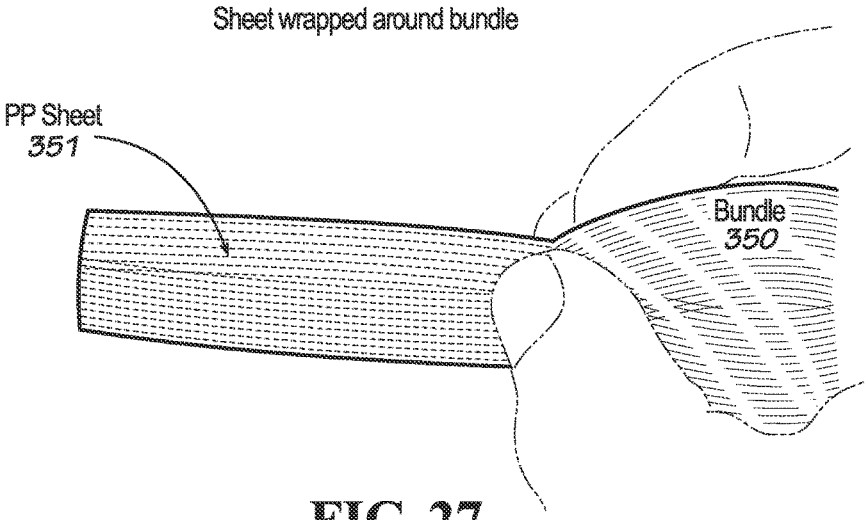

FIG. 27 shows a polypropylene sheet 351 wrapped around the bundle 350.

Figure 28:
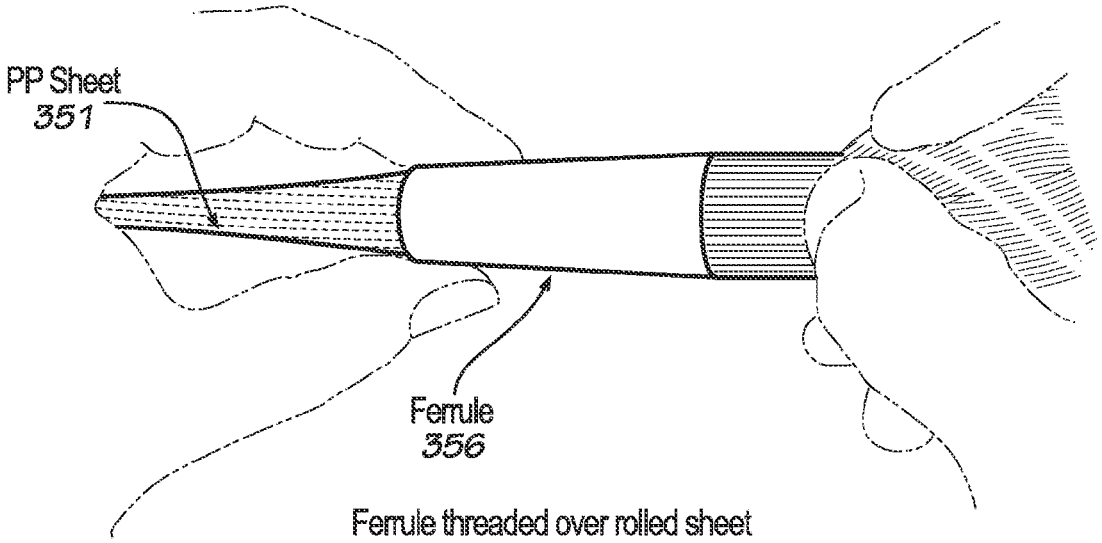

FIG. 28 shows the ferrule 356 threaded over the elongate sheet/bundle combination, which would be done in a left to right motion as the figure is viewed.

Figure 29:
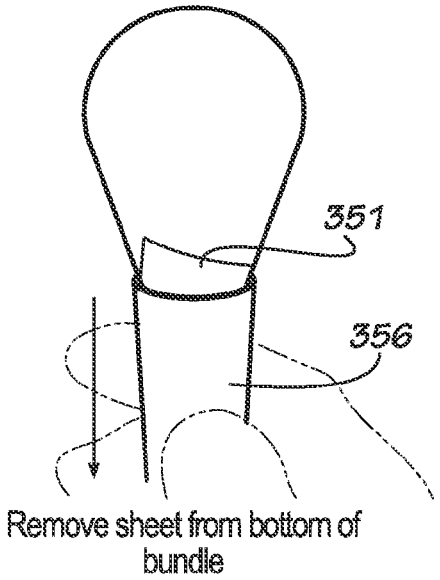

FIG. 29 shows the sheet 351 being pulled off the bottom of the bundle, through the lower (in the FIG. 29 view) opening of the ferrule 356 (a flap of the sheet is shown just prior to disappearing under the ferrule).

Figure 30:
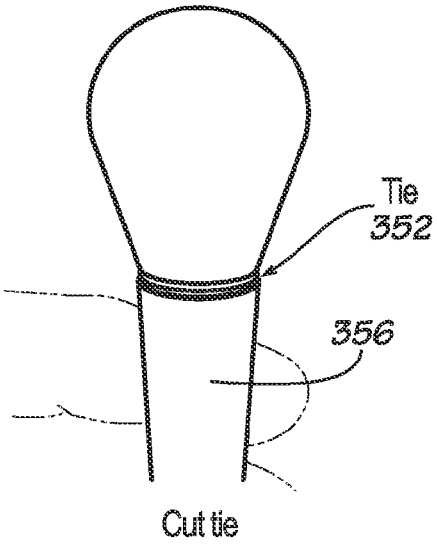

FIG. 30 shows the tie 352 just prior to being cut.

Figure 31A:
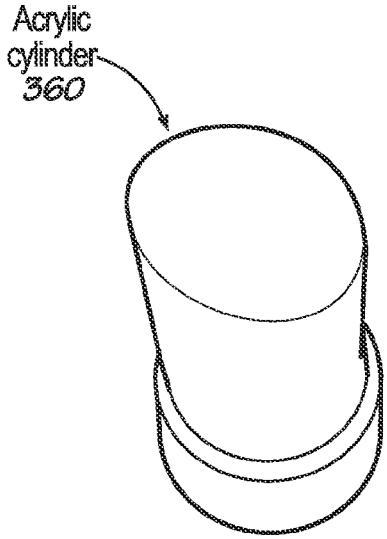

FIG. 31A shows an acrylic cylinder 360 having one end shaped based on the desired shape of the working brush end.

Figure 31B:
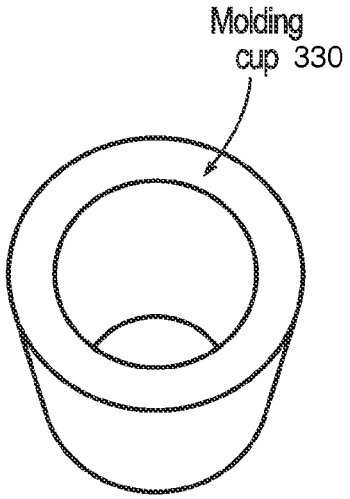

FIG. 31B shows a molding cup 330 used in association with the acrylic cylinder 360.

Figure 32:
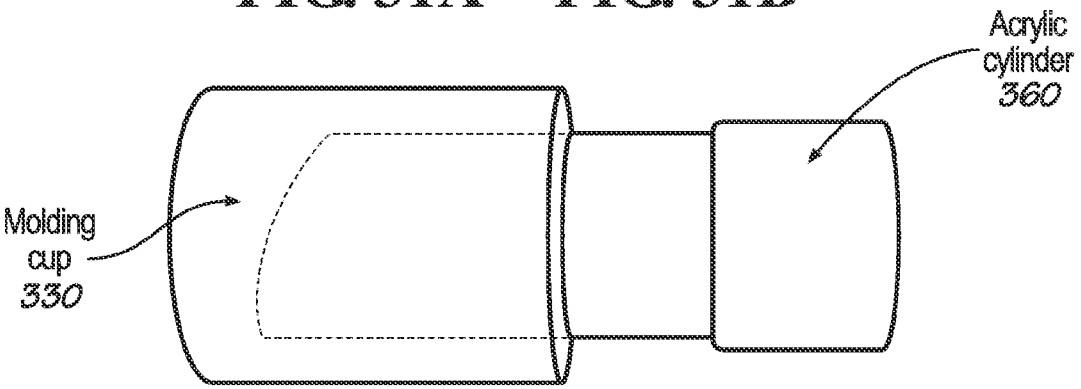

FIG. 32 show shows the acrylic cylinder 360 inserted into the molding cup 330 as far as it can (a small shoulder provides a stop).

Figure 33:
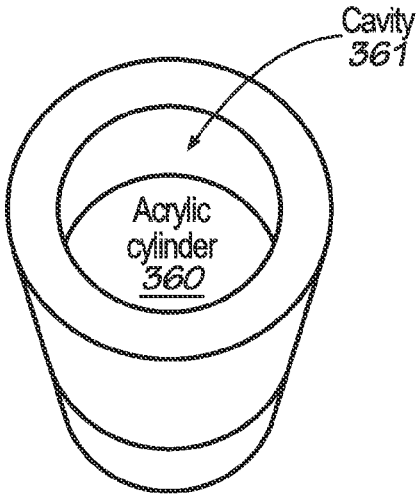

FIG. 33 is another view of the combination shown in FIG. 32, except that it provides a better view of the cavity into which the moldable material is placed.

Figure 34A:
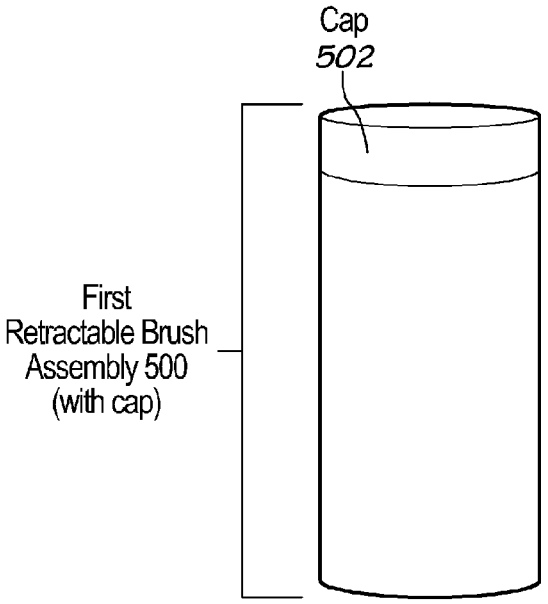
Figure 34B:
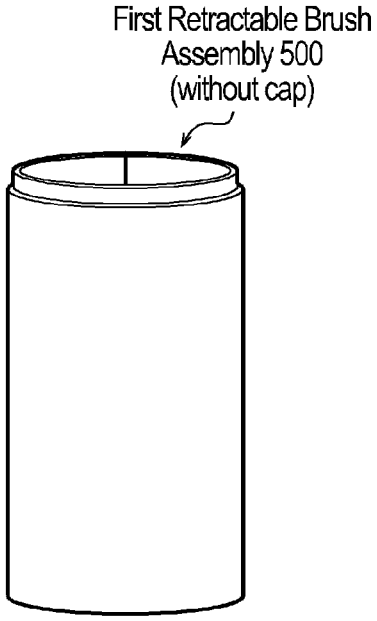

FIGS. 34A and 34B show two respective conditions of a first embodiment retractable brush assembly 500, the FIG. 34A condition being with a cap 502 on, and the FIG. 34B condition being with the cap 502 off.

Figure 35A:
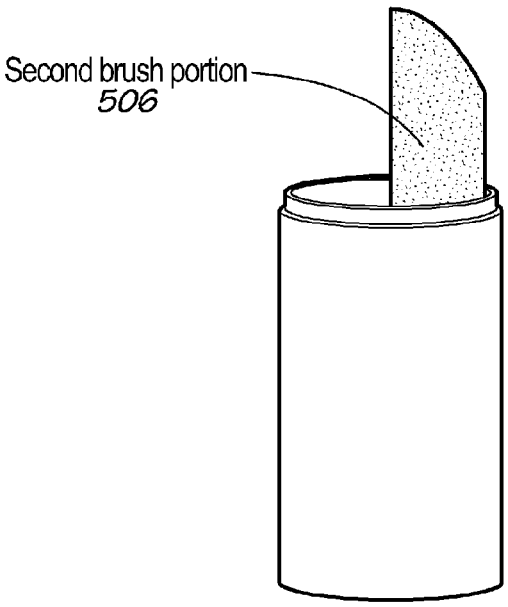
Figure 35B:
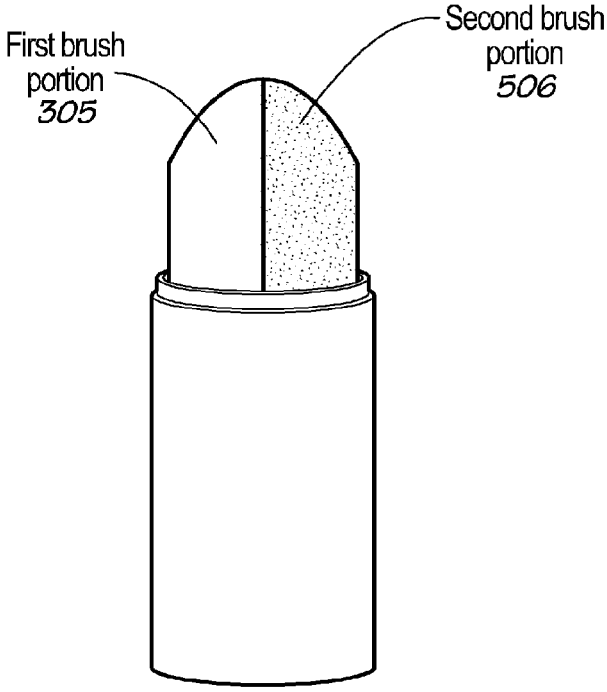

FIGS. 35A and 35B show two conditions of first embodiment retractable brush assembly 500, the FIG. 35A condition being with only the second brush portion 506 extended (first brush portion is still retracted), and the FIG. 35B condition being with both brush portions 505 and 506 being extended.

Figure 36:
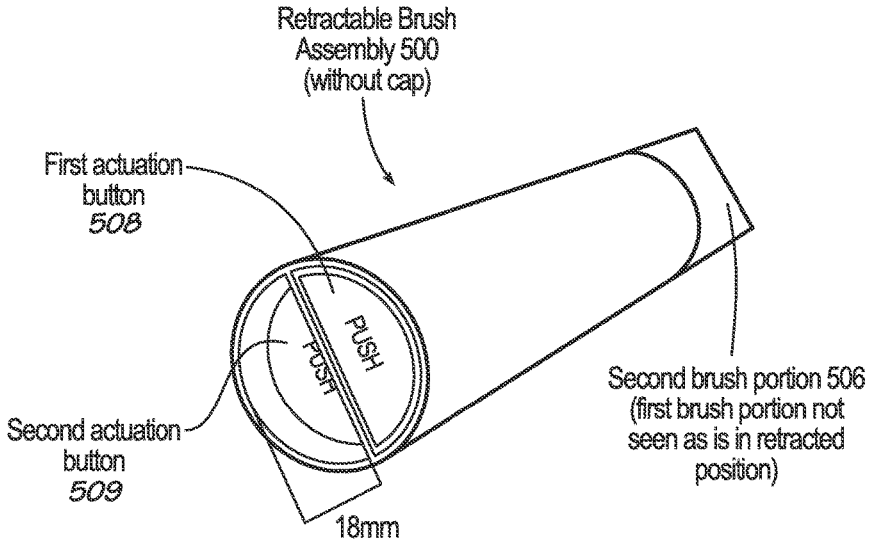

FIG. 36 shows a pictorial view of a retractable brush assembly 500 (without a cap). The first actuation button 508 is shown in an undepressed state, and the second actuation button 509 is shown in a depressed state. The second brush portion 506 is out, but the first brush portion 504 is in and not seen in this figure. First brush portion 504 would be in front of the second brush portion 506 if it was out.

Figure 37:
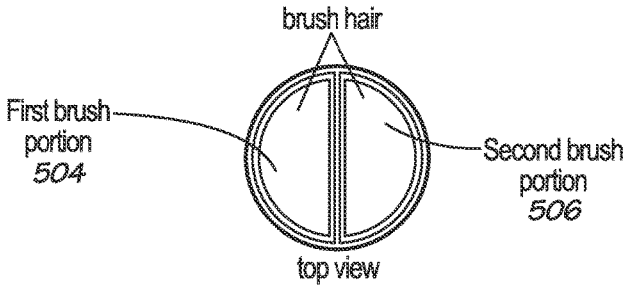

FIG. 37 shows a top end view of the application end of the retractable brush assembly 500. Shown are the first brush portion 504 and the second brush portion 506.

Figures 38A, 38B, 38C:
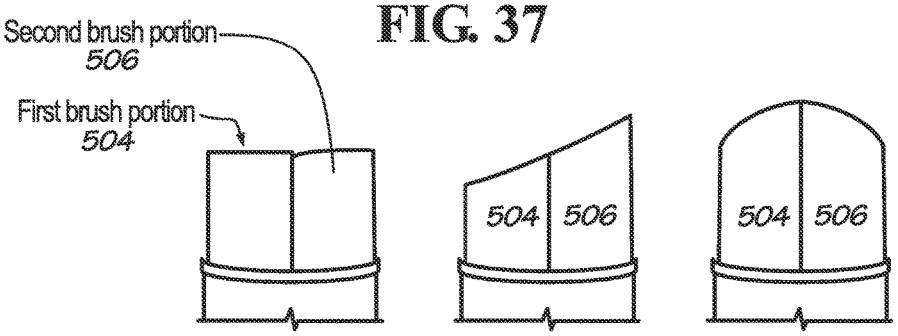

FIGS. 38A-38C are three illustrative side views of the application end of the retractable brush assembly 500, showing three different brush profiles with both the first brush portion 504 and the second brush portion 506 extended. FIG. 38A shows a relatively flat end, FIG. 38B shows an angular configuration, and FIG. 38C shows a rounded end.

Figure 39A:
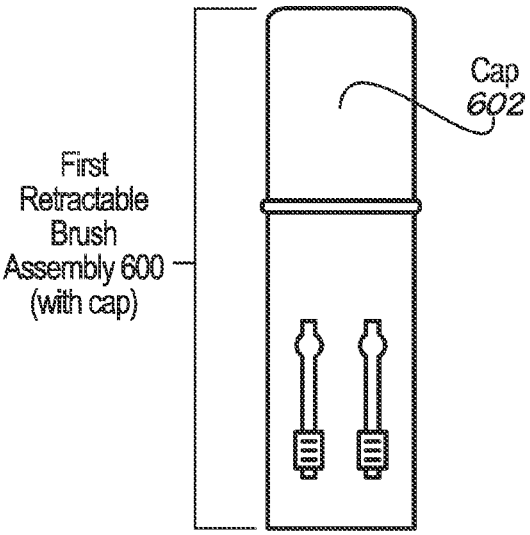
Figure 39B:
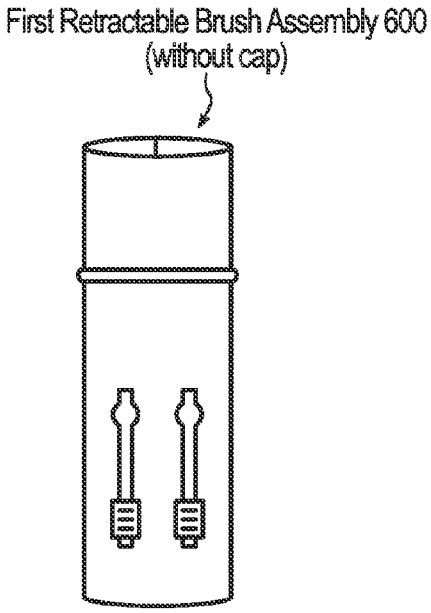

FIGS. 39A-39B show two conditions of a second embodiment retractable brush assembly 600, the FIG. 39A condition being with a cap 602 on, and the FIG. 39B condition being with the cap 602 off.

Figure 40A:
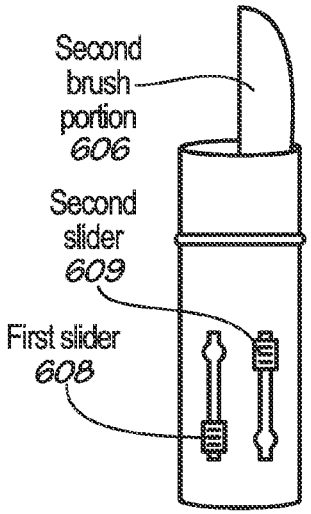
Figure 40B:
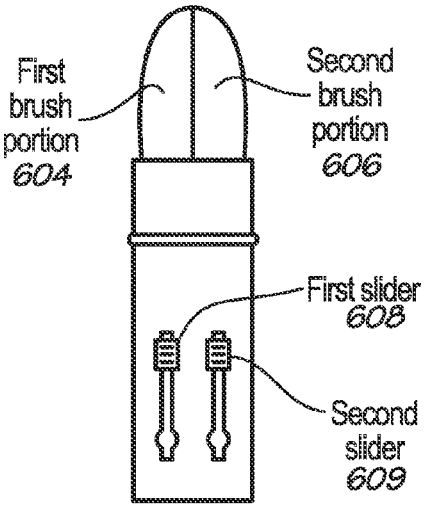

FIGS. 40A-40B show two conditions of a second embodiment retractable brush assembly 600, the FIG. 40A condition being with only the second brush portion 606 extended (first brush portion is still retracted), and the FIG. 40B condition being with both brush portions 604 and 606 being extended.

Figure 41:
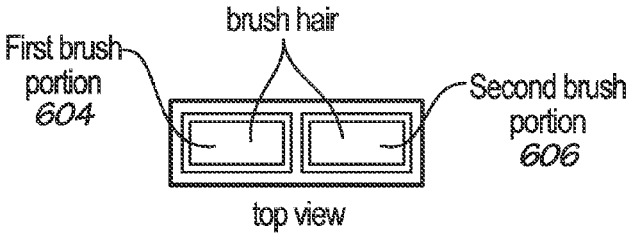

FIG. 41 is an application end view showing one configuration of the second embodiment retractable brush assembly 600, having a generally rectangular outer peripheral shape.

Figure 42:
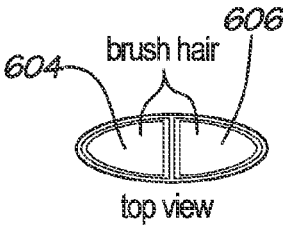

FIG. 42 shows an application end view showing another configuration of the second embodiment retractable brush assembly 600, having a generally rectangular outer peripheral shape.

Figure 43:
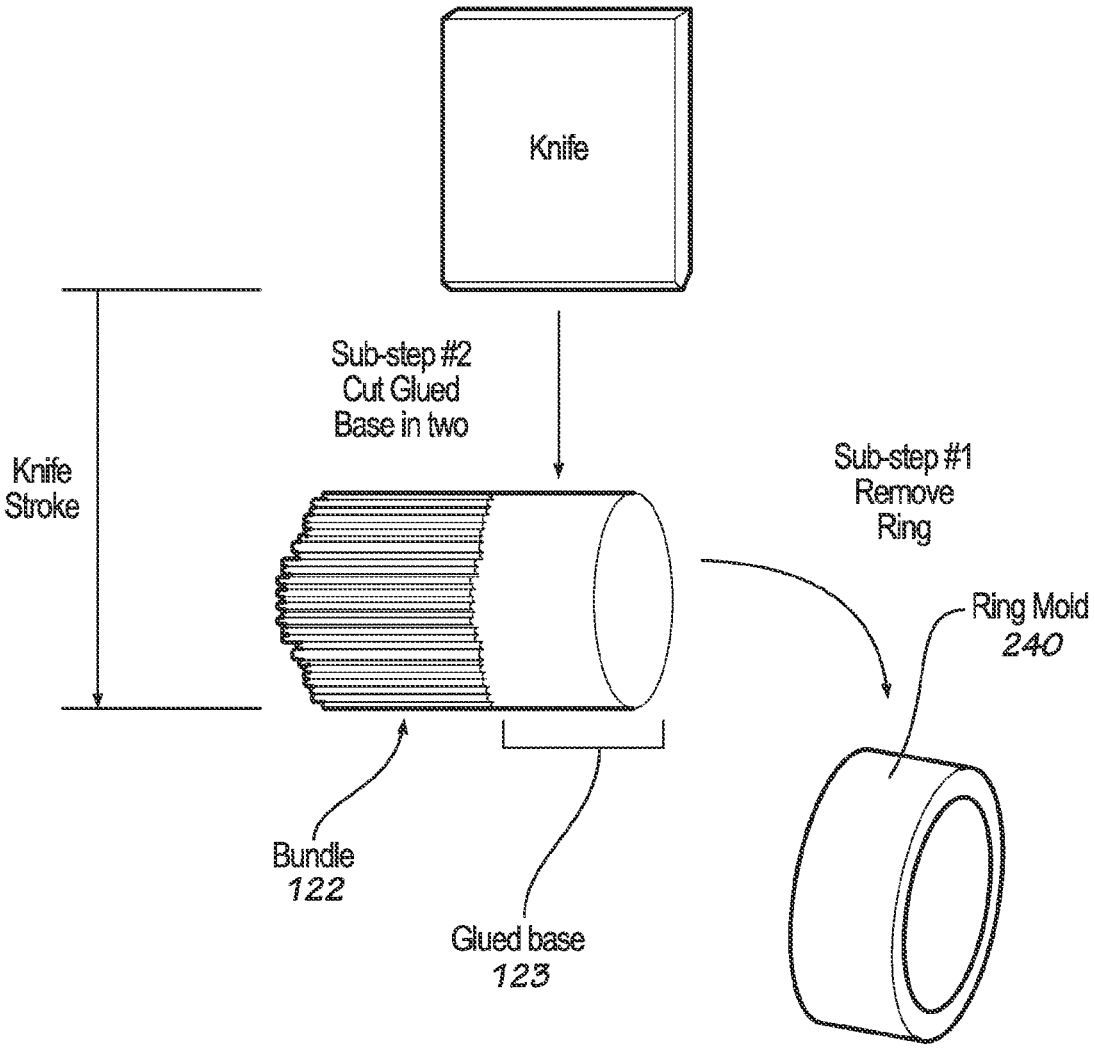

FIG. 43 shows an alternate manner of cutting the glued base 123 in two—by first removing the ring mold and then cutting the glued base by introducing a knife edge into the glued base such that the knife edge remains substantially parallel to the longitudinal axes of the bristles in the bristle bundle 122, and slicing is done along a plane being substantially parallel to the longitudinal axes of the bristles. This replaces the processes shown in FIGS. 8 and 9. In both situations, the glued base is cut completely in half.

DETAILED DESCRIPTION OF THE INVENTION

I. Element List

10 One brush embodiment
- 12 brush head
- 14 brush handle
- 16 ferrule
- 18 longitudinal axis
- 20 bristles of a first type
- 22 bristles of a second type

100 First Manufacturing Process
- 110 dual sided brush head
- 120 synthetic fibers
- 122 bundle of brush fibers
- 123 glued base
- 128 Slice
- 130 natural fibers
- 138 Slice
- 220 Scale
- 230 Shaping mold
- 240 Ring mold
- 270 Slicing apparatus
- 290 Ferrule

300 Second Manufacturing Process
- 310 Natural Hair/Fiber
- 320 Synthetic Hair/Fiber
- 330 Molding Cup
- 332 Slits (2)
- 340 Metal Dividing Plate
- 342 First Area
- 344 Base of moldable putty
- 345 Divided mold
- 350 Bundle
- 352 tie
- 354 ring

356 ferrule
358 adhesive
360 acrylic cylinder
361 cavity
400 Dual sided brush
500 First Embodiment Retractable Brush Assembly
502 Cap
504 First brush portion
506 Second brush portion
508 First half-circle-shaped button
509 Second half-circle-shaped button
600 Second Embodiment Retractable Brush Assembly
602 Cap
604 First brush portion
606 Second brush portion
608 First slider
609 Second slider

II. Detailed Description

Reference will now be made in detail to one or more embodiments of the present brushes, an example of which is illustrated in the accompanying drawings. The embodiments are described by way of explanation, and not by way of limitation.

A) The Brush 10

Referring to the drawings, particularly FIG. 1, one embodiment of a brush indicated generally by the reference numeral 10 comprises a brush head 12, a brush handle 14, and as ferrule 16.

The handle 14 is generally circular in cross section, but may be another shape such as elliptical, and has a longitudinal axis 18. As shown in FIG. 1, the handle 14 is relatively long and thin. However, the length and thickness of the handle 14 depend on the intended use of the specific brush, as is well known to those skilled in the art The brush head 12 comprises bristles 20, 22 that are aligned generally parallel to the axis 18. As shown in FIG. 1, the bristles 20, 22 spread slightly away from the axis 18 in the direction away from handle 14. The amount of spread may vary. The bases of the bristles 20, 22 are surrounded, supported, and secured to an end of handle 14 by ferrule 16.

The bristles 20, 22 are of two different sorts, each making up one half of the head 12. For example, the bristles 20 making up one half of the head 12 may be natural bristles, and the bristles 22 making up the other half of the head 12 may be synthetic fiber. The bristles 20 may be a different color from the bristles 22, either naturally or through being deliberately colored. For purposes of this discussion the bristles 20 may be referenced as of the "first" type, and the bristles 22 may be of the "second" type.

As shown in FIG. 1, the head 12 is broadly rounded, so that by applying the brush 10 obliquely to a flat surface, bristles of only one sort 20 or 22 can be brought into contact with the surface.

In use, the brush 10 may be used like a conventional cosmetic applicator brush to apply cosmetics or skin care products to the skin, blend cosmetics into the skin or with other cosmetics, and the like. However, by holding the brush 10 obliquely to the skin or to a container of cosmetic material, and by rotating the brush 10 to a suitable orientation about the axis 18, a chosen one of the bristles 20 or 22, or a mixture at the borderline between the two halves, can be used.

For example, one sort of bristles 20 or 22 may be more suitable for transferring a cosmetic from a container to the skin, and the other sort of bristles 22 or 20 may be more suitable for blending the cosmetic on the skin. For mineral based makeup, such as powders, blushes, bronzers, etc., it may be desired to use synthetic fibers to apply the makeup and natural fibers to blend and soften the appearance of the makeup.

For example, a blush may be applied to the user's cheekbone with the synthetic fibers and the blush may then be blended on the cheekbone with the natural fibers. For pan or pressed products such as pressed powders, eye shadows, etc., it may be desired to use natural fibers to apply and synthetic fibers to blend. For example, eye shadow may be applied with the natural fibers and then blended with the synthetic side of the brush. However, two different natural fibers or two different synthetic fibers could also be used.

For example, the two sides may be used for applying different cosmetics, reducing the level of cross-contamination of one cosmetic by the other without the need to use two different brushes. A brush with two sides of different appearance but having fibers of the same or similar mechanical properties may then be useful. A brush in which the two sides differ only in color or other properties of appearance may also be useful for user training or education, or for easy identification by the user of brushes of similar size and shape.

By having the two sides 20, 22 of markedly different colors, for example, one side white and the other side black, the user can tell at a glance which side is which, and can immediately and correctly align the brush for use.

In various embodiments, the two types of brush hairs are selected or blended from a wide range of natural hairs (e.g., goat, pony, sable, and the like), synthetic hairs well known in the art (e.g., nylon, polyester, Taklon fiber, polybutylene terephthalate or polyamide), or blends of synthetic fibers. These brush hairs may vary in characteristics such as stiffness (stiffer vs. more flexible), hardness (harder vs. softer), or bristle end structure (for example, a simple cut end vs. a pointed end vs. a split end). Synthetic brush hairs may be grooved or roughened. The different types of brush hair may be a single fiber or may be a blend or fibers or colors.

B) Manufacturing Process 100

FIGS. 2-15 depict an embodiment of a brush head manufacturing method 100 of the present invention, in which a slicing apparatus is used to assemble a brush head using two types of brush hairs or fibers in a side-by-side configuration in the same ferrule, with each of two bristle portions being comprised of a plurality of elongate flexible bristles being substantially aligned along their lengths, each of the bristle portions having two opposing ends, one end being an application end and the other end being a securing end.

Steps 1-5: Preparation of Brush Hairs

FIG. 2, which shows Steps 1 through 5, depicts a process by which brush hairs are prepared for placement in a brush according to an embodiment of the present invention. In Step 1, synthetic fibers 120 are sorted according to conventional methods. In Step 2, the synthetic fibers 120 are blended using a tool known in the art. In Step 3, the sorted and blended synthetic fibers 120 are combed with a combing instrument 210. As shown in Steps 4 and 5, the sorted and blended synthetic fibers 120 are then packed so they align roughly parallel to one another and to protect the fibers from being contaminated with other types of fibers or hairs. For the present invention, Steps 1 through 5 are repeated using natural fibers 130. Referencing back also the FIG. 1, it should be understood that the synthetic fibers could be the bristles of a first type 20 and the natural fibers 130 could be the bristles of a second type 22 (or vice versa).

Steps 6A-13A: Assembly of Dual Sided Brush Head Using Slicing Apparatus

FIGS. 2-13 are directed to a method of manufacturing a dual sided brush head 110 using the synthetic fibers 120 and natural fibers 130 prepared according to Steps 1-5 of FIG. 1, or according to another embodiment of the present invention. In the present embodiment, the synthetic fibers 120 are subjected to Steps 6A-11A to create two synthetic fiber slices, and the natural fibers are similarly subjected to Steps 6A-11A to create two natural fiber slices. One synthetic fiber slice and one natural fiber slice are combined to create a single brush head for a cosmetics brush. For purposes of illustration, FIGS. 2-13 show Steps 6A-11A as performed with natural fibers. However, as indicated in Step 6A, the process is the same when performed with synthetic fibers. Therefore, Steps 6A-11*a* are described below as applying to both natural and synthetic fibers.

In Step 6A, as shown in FIG. 3, a bundle 122 of brush hairs is selected and pulled from the pack of synthetic fibers 120 (or similarly a bundle of brush hairs is pulled from the pack of natural fibers 130) and weighed. For example, in various embodiments, an equal weight of synthetic and natural fibers may be desired for a particular brush head. As such, a conventional scale 220 may be used to isolate a bundle of fibers 122 having a certain weight.

In Step 7A, as shown in FIG. 4, the selected bundle 122 of brush hairs is placed in a shaping mold 230, which has an open end and a closed end, and defines an upwardly-directed cavity. The cavity is shaped according to a desired shape for the brush head, in particular the desired predetermined brush application tip profile. It may also be understood that the forming mold defines a cavity surface substantially corresponding to the desired predetermined brush application tip profile. In the present embodiment, the cavity is rounded on the bottom so that the end of the bundle 122 making contact with the mold forms a domed shape. For example, the cavity bottom could be flat, pointed, or otherwise shaped, and the brush hairs in the bundle would similarly conform to the shape. In this step, the shaping mold 230 may be subjected to gentle shaking or tapping in order to encourage the brush hairs into a conforming position.

At Step 8A, as shown in FIG. 5, a ring mold 240 is placed around the tail end of the bundle 122, either while it is situated in the shaping mold 230, or upon removal from the shaping mold 230, to maintain or adjust the shape of the bundle 122. The ring mold 240 may be sized or adjusted to form a secure fit around the bundle 122. In the present embodiment, the ring mold 240 is elliptical in shape. However, in other embodiments, the ring mold may be a circular, square, or any other shape.

In Step 9A, conventional tools and methods known in the art are then used, as shown in FIG. 6, to trim excess brush hair from the tail end of the bundle 122 while the ring mold 240 still holds the bundle 122 in place.

At Step 10A, as shown in FIG. 7, a layer of adhesive 250 is injected into the base of the bundle 122 while it is held by the ring mold 240. A suitable adhesive known in the art is Max-Bond Glue 888. The adhesive 250 infiltrates between the hair ends, downward into the bundle 122, and dries to form a glued base.

At Step 11A, as shown in FIG. 8, a slicing apparatus 270 is used to cut through the glued base, across the width of the ring mold 240, for at least the depth penetrated by the adhesive 250. The slicing apparatus has a stabilizing component that grasps the ring mold 240 and a knife that is situated to cut through the glued base. In FIG. 9, the bundle 122 is shown be divided into a pair of slices 128 (or slices 138, if of the other fiber type), which are held together by the ring mold 240, unless it has been cut all the way through as well.

At step 12A, as shown in FIG. 9, the slices are removed from the ring mold 240 so that they are separated as shown in FIG. 10. In the present embodiment, the glued base is cut along the major axis, so that the slices are equal in shape and size. However, in various embodiments, the bundle 122 can be cut along any radii, creating unequally shaped slices. For example, in other embodiments, the first slice 128*a* may be larger than the second slice 128*a*, or vice versa.

In the present embodiment, the slices 128 are both comprised of synthetic fibers 120. According to the process of this embodiment, the natural fibers 130 are subjected to the same steps, resulting in slices 138, which are both comprised of synthetic fibers 130.

At step 13A, as shown in FIG. 11, a synthetic slice 128 and a natural slice 138 are joined to create a dual sided brush head 110.

In step 14A, as shown in FIG. 12, the dual sided brush head 110 is placed into an open end of a ferrule 290.

At step 15A, as shown in FIG. 13 an adhesive is injected into the ferrule 290 to bond the dual sided brush head 110 inside the ferrule 290. The adhesive is allowed to dry for an appropriate amount of time.

At step 16A, as shown in FIG. 14 the ferrule 290 is pressed around the dual sided brush head 110, using a conventional pressing machine. A handle (not shown) can also be connected to the ferrule, depending on the type of cosmetic brush desired. The resultant brush 10, shown in FIG. 15, has a dual sided brush head 110 comprised of synthetic fibers 128*a* on one side, adjacent to natural fibers 138*a* on the other side, all within the same ferrule 290.

Summary of Steps of Process 100

| Step(s) | FIG. | Step Detail |
|---|---|---|
| Steps 1-5 | 2 | Preparing Fibers |
| Step 6A | 3 | Weighing |
| Step 7A | 4 | Doming or other shaping via use of a shaping mold |
| Step 8A | 5 | Ring mold placed around tail end of bundle |
| Step 9A | 6 | Trim excess brush hair from the tail end of the bundle |
| Step 10A | 7 | Layer of adhesive 250 is injected into the base of the bundle 122 while it is held by the ring mold 240 |
| Step 11A | 8 | Slicing apparatus 270 is used to cut through the glued base, across the width of the ring mold 240, for at least the depth penetrated by the adhesive 250. |
| Step 12A | 9, 10 | Slices 128a and 128b are removed from the ring mold 240 |
| Step 13A | 11 | Synthetic slice 128a and the first natural slice 138a are joined to create a dual sided brush head 110 |
| Step 14A | 12 | Dual sided head 110 is placed into an open end of a ferrule 290 |
| Step 15A | 13 | Adhesive is injected into the ferrule 290 to bond the dual sided brush head 110 inside the ferrule 290 |
| Step 16A | 14 | Ferrule 290 is pressed around the dual sided brush head 110, using a conventional pressing machine |

C. Manufacturing Process 300

Steps 7B-14B: Assembly of Dual Sided Brush Head Using Divided Mold

FIGS. 16-25 depict another brush head manufacturing method 200 according to the present invention, in which a divided mold 345 is used to assemble a brush head using two types of brush hairs or fibers in a side-by-side configuration in the same ferrule, such as shown in FIG. 25, with each of two bristle portions being comprised of a plurality of elongate flexible bristles being substantially aligned along their lengths, each of the bristle portions having two opposing ends, one end being an application end and the other end being a securing end.

Under this manufacturing process 300, steps 1-5 of FIG. 2 are used to prepare the brush hairs as in the previous process 100, as is step 6 of weighing of FIG. 3. Steps 7B-13B, described below, are described in reference to FIGS. 16-25.

In order to use this process 300, a divided mold 345 must first be prepared. FIG. 16 is a top view of the divided mold 345 used in the present embodiment. The divided mold 345 is comprised of a molding cup 330 having two slits 332 in the cup wall, each slit configured to hold one end of a dividing plate 340. The dividing plate 340 separates a first area 342 from a second area 344 of the divided mold 345. It may be understood that the forming mold defines a cavity surface substantially corresponding to the desired predetermined brush application tip profile.

The molding cup 330 has a base 344, which in the present embodiment is sloped, as shown in FIG. 16, although other configurations may easily be provided; the base 344 in the present embodiment consists of a moldable putty that can be shaped according to the desired form of the brush head, in particular the desired predetermined brush application tip profile. The molding cup 330 in one configuration is a plastic open-ended cylinder with a side wall of consistent thickness, in combination with a moldable base 344 closing one end of the cylinder.

As shown in FIG. 17, a pair of slits 332 is cut into the wall of the molding cup 330. The slits 332 are positioned according to the desired proportions of the relative brush hairs. As shown in FIG. 18, the metal plate 340 is inserted into the slits 332 to define the first area 342 and the second area 344 of the divided mold 345. In the present embodiment, the slits 332 are situated along a minor radius of the molding cup, such that the first area 342 is smaller than the second area 344. However, in other embodiments, the slits 332 may be diametrically opposed, so that the first area 342 and second area 344 comprise equal halves. Other configurations may easily be used as well.

In order to provide a brush such as shown in FIG. 25, steps 1-5 of FIG. 2 are used to prepare the brush hairs as in the previous process 100, as is step 6 of weighing of FIG. 3. Steps 7B-13B, described below, are described in reference to FIGS. 16-25.

At Step 7B, as shown in FIG. 19, natural hair 310 is selected and inserted into the first area 342 of the divided mold 345. Similarly, at Step 8B, as shown in FIG. 20, synthetic hair 320 is selected and inserted into the second area 344 of the divided mold 345.

At Step 9B, as shown in FIG. 21 the hairs 310 and 320 are removed as a whole from the divided mold 345 and held together as a bundle 350 with a tie 352. As shown in FIG. 18, the bundle 350 is angularly shaped at the top, as a result of the angled base 344 of the molding cup 330.

At Step 10B, as shown in FIG. 22 the base of the bundle 350 is inserted into a ring 354, which may be formed of polyethylene using conventional methods.

At Step 11B, as also shown in FIG. 22, hairs protruding from the bottom of the ring 354 are trimmed using conventional methods.

At Step 12B, as shown in FIG. 23, an adhesive 358 is injected into a ferrule 356. At Step 13B, as shown in FIG. 24, the ring 354 is inserted into the ferrule 356, and the adhesive 358 is allowed to dry. The result is an angled dual sided kabuki brush 400 as shown in FIG. 25. It should be understood the angled shape shown is only an example of many that may be provided and should not be considered as limiting to the invention.

FIG. 43 shows an alternate manner of cutting the glued base 123 in two—by first removing the ring mold and then cutting the glued base by introducing a knife edge into the glued base such that the knife edge remains substantially parallel to the longitudinal axes of the bristles in the bristle bundle 122. This replaces the processes shown in FIGS. 8 and 9. In both situations, the glued base is cut completely in half.

D. Dual-Sided Manufacturing Process #2

| Step(s) | FIG. | Step Detail |
|---|---|---|
| Steps 1-6 | | Same as described above |
| Step 7B | 19 | Natural hair 310 is inserted into the first area 342 of the divided mold 345 |
| Step 8B | 20 | Synthetic hair 320 is inserted into the second area 344 of the divided mold 345 |
| Step 9B | 21 | Hairs 310 and 320 are removed as a whole from the divided mold 345 and held together as a bundle 350 with a tie 352 |
| Step 10B | 22 | Base of the bundle 350 is inserted into a ring 354 |
| Step 11B | 22 | Hairs protruding from the bottom of the ring 354 are trimmed |
| Step 12B | 23 | Adhesive 358 is injected into a ferrule 356 |
| Step 13B | 24 | Base of the bundle 350 is inserted into a ring 354 |

Details Regarding Insertion of Tied Bundle into Ferrule

As noted at Step 10B above, the base of a bundle is inserted into a ring, and then the ring is attached to a ferrule later in Step 13B. In the alternative, the base of a bundle may be directly inserted into a metal ferrule such as 356 as shown in FIGS. 26-30.

As shown in FIG. 26, a tied bundle 350 is placed atop a polypropylene sheet 351, which is then wrapped around a bottom portion of the bundle as shown in FIG. 27. The tie used in FIG. 27 is numbered 352 in FIG. 30 below. As shown in FIG. 28. The ferrule 356 is then threaded over the elongate sheet/bundle combination while the sheet keeps the bristles in place and manageable while the ferrule is put into place. Once the ferrule is in place as shown in FIG. 29, the sheet 351 is pulled off the bottom of the bundle, through the lower (in the FIG. 29 view) opening of the ferrule 356. The tie 352 shown in FIG. 30 is then cut. The ferrule 356 can then be mechanically crimped or otherwise deformed as needed to capture the bundle 350 therein; glue can be used as where and as needed.

Definition of the Moldable Base 332

As discussed above, the moldable base 344 of, for example, FIGS. 16-18, provides a defining space within which the working ends of the brush fibers conform. This moldable base 344 can be of moldable putty. FIGS. 31-33 show one manner in which the base 344 can be molded to the needed shape.

FIG. 31A shows an acrylic cylinder 360 having one end shaped based on the desired shape of the working brush end. FIG. 31B shows a molding cup 330 similar to that of FIGS. 16-18, although its slits have not been added and it does not have a bottom. FIG. 32 shows the acrylic cylinder 360 inserted into the molding cup 330 as far as it can (a small shoulder provides a stop). FIG. 33 is another view of the combination shown in FIG. 32, except that it provides a better view of the cavity into which the moldable material is placed. As may be understood, moldable material is placed into this cavity, and then the acrylic cylinder "molding form" is removed. Thus the base 344 of moldable putty of FIGS. 16-18 is provided.

Use, Advantages, Alternatives

With the cosmetic brushes 10 and 400 having natural hairs on one side and synthetic hairs on the other side, the natural hairs can be used to lightly apply cosmetic powders without interference from the synthetic hairs. The synthetic hairs can be used to apply emollient-based cosmetics without interference from the natural hairs.

One advantage of the dual sided cosmetic brushes 10 and 400 manufactured according to the present invention over brushes known in the art is that the dual sided cosmetic brushes 10 and 400 incorporate the benefits of two types of hair without diluting the properties of either, as could happen when conventionally blending the types of hairs and making a brush head treating the blended hairs as a single type. The second type of brush hair may be better suited for applying a cosmetic powder, and the first type of brush hair may be better suited for blending the cosmetic powder.

Those skilled in the art will understand that additional cosmetic brushes with two or more sets of brush hairs can be created using variations of the dual sided brush head manufacturing method described herein. For example, in one embodiment, three or more types of brush hairs can be combined to create a brush head.

E. Retractable Dual Brush Assemblies

Also provided under the present invention are retractable (aka extendable) dual brush assemblies. Disclosed herein are two general types of embodiments. In each of these configurations, there are two segments of brush segments positioned side by side and slidably mounted relative to an enclosing handle. Either of the brush segments can be independently moved from a retracted, concealed, position to an extended, exposed, position. If so desired, only one brush segment can be extended at a time, or both can be extended at the same time. If both are extended at the same time, they can in effect combine to form a single brush.

There are at least two ways this can be accomplished—via a "snap" action such as shown in FIGS. 34-38 or a "slide" action such as shown in FIGS. 39-44.

1) Version 1—"Snap" Action (FIGS. 34-38)

In this version, a "snap-to-extend"/"snap-to-retract" configuration is used, with two half-circle-shaped actuation buttons on the bottom of the handle being depressible to actuate a "snap" action. This could also be referenced as a "latching" switch in that when a button is pressed downward from its "out" position (typically against spring pressure), and it is pushed far enough, it can then be "latched" in the "in" position. When pressed again, the latch is disengaged and the button is allowed to go back to its "out" state, typically under spring pressure. This may be generally referenced as a "latched push button" configuration.

This could be referenced as a "pen-snap" action, in that the action is much like a writing pen retraction/extension configuration, in which the user presses a button on the end of a pen opposite the writing end, in order to alternately retract and extend the ball point tip at the other end.

Reference is now made generally to FIGS. 34-38. FIGS. 34A and 34B show two respective conditions of a first embodiment retractable brush assembly 500, the FIG. 34A condition being with a cap 502 on, and the FIG. 34B condition being with the cap 502 off.

FIGS. 35A and 35B show two conditions of first embodiment retractable brush assembly 500, the FIG. 35A condition being with only the second brush portion 506 extended (first brush portion is still retracted), and the FIG. 35B condition being with both brush portions 505 and 506 being extended FIG. 36 shows a pictorial view of a retractable brush assembly 500 (without a cap). The first actuation button 508 is shown in an undepressed state, and the second actuation button 509 is shown in a depressed state. The second brush portion 506 is out, but the first brush portion 504 is in and not seen in this figure. First brush portion 504 would be in front of the second brush portion 506 if it was out.

FIG. 37 shows a top end view of the application end of the retractable brush assembly 500. Shown are the first brush portion 504 and the second brush portion 506.

By depressing one of the two actuation buttons, a corresponding brush portion is alternately extended or retracted. For example, depending on its initial position, pressing first actuation button 508 causes first brush portion 504 to move in (against spring pressure) to a depressed position, or to move out (via spring pressure) to a undepressed position. Pressing it again causes the opposite action. Depending on its initial position, pressing second actuation button 509 causes second brush portion 506 to move in to a depressed position, or to move out to an undepressed position. Pressing it again causes the opposite action.

It should be understood that the actuation buttons are configured to be operated independently of each other, such that both first and second brush portions 504, 506, respectively can be out, both can be in, or only one can be out, and the other in.

Reference is now made to FIGS. 38A-C, which are three illustrative side views of the application end of the retractable brush assembly 500, showing three different brush profiles with both the first brush portion 504 and the second brush portion 506 extended. FIG. 38A shows a relatively flat end, FIG. 38B shows an angular configuration, and FIG. 38C shows a rounded end.

The manufacturing process would be similar to what has already been detailed, but rather than placing the head in a regular ferrule and head, it would be positioned in a retractable mechanism.

2) Version 2—"Slide" Action (FIGS. 39-42)

In this version a "slide-to-extend" and "slide-to-retract" configuration is used, with slidable buttons (first and second "sliders" 608, 609), positioned on the side of the handle to provide the "sliding" action.

FIGS. 39A-39B show two conditions of a second embodiment retractable brush assembly 600, the FIG. 39A condition being with a cap 602 on, and the FIG. 39B condition being with the cap 602 off.

FIGS. 40A-B show two conditions of a second embodiment retractable brush assembly 600, the FIG. 40A condition being with only the second brush portion 606 extended (first brush portion is still retracted), and the FIG. 40B condition being with both brush portions 604 and 606 being extended. Also shown are first and second sliders 608, 609, corresponding to first and second brush portions 604, 606, respectively.

FIG. 41 is an application end view showing one configuration of the second embodiment retractable brush assembly 600, having a generally rectangular outer peripheral shape.

FIG. 42 shows an application end view showing another configuration of the second embodiment retractable brush assembly 600, having a generally rectangular outer peripheral shape.

It should be understood that the first and second sliders 608, 609 are configured to be operated independently of each other, such that both first and second brush portions 604, 606, respectively can be out, both can be in, or only one can be out, and the other in.

The manufacturing process would be similar to what has already been detailed, but rather than placing the head in a regular ferrule and head, it would be positioned in a retractable mechanism.

III. Conclusion

Various modifications and variations can be made in the present invention without departing from the spirit or scope of the invention. Thus, it is intended that the present invention cover the modifications and variations of this invention provided they come within the scope of the appended claims and their equivalents.

Although distinct embodiments have been described, the skilled person will understand how features of different embodiments may be combined.

What is claimed is:

1. A cosmetics brush comprising a generally elongate handle having a longitudinal axis and a head extending from one end of said handle, said head having an application end viewed as generally circular when viewing said application end substantially along said longitudinal axis, wherein said head comprises bristles extending endways from said one end of said handle, said bristles including:

a first set of bristles having a first set of properties and including a first set of bristle ends; and a second set of bristles adjacent to said first set of bristles, said second set of bristles having a second set of properties and including a second set of bristle ends, said first and second sets of bristles being positioned adjacent to each other generally along opposing sides of an interface extending generally along said longitudinal axis of said handle, and said first and second sets of bristle ends each configured such that they combine to define approximately at least a half sphere, with each of said two sets of bristle ends viewed as generally semicircular when said application end is viewed substantially along said longitudinal axis.

2. The cosmetics brush as claimed in claim 1, wherein said first and second sets of bristles are positioned laterally adjacent to each other in roughly equal halves.

3. A cosmetics brush for applying cosmetics to a flat skin surface, said brush comprising a handle and a head, wherein said head comprises bristles extending endways from an end of said handle and terminating at bristle ends, said bristle ends combining to define a cosmetics application face, said bristles including:

a first set of bristles having a first set of properties and including a first set of bristle ends; and a second set of bristles adjacent to said first set of bristles and having a second set of properties and including a second set of bristle ends, said first and second bristle ends combining to define said cosmetics application face, said first and second sets of bristle ends each configured to have a corresponding broadly rounded portion, said first and second sets of bristles being positioned adjacent to each other so as to define a borderline extending from one edge of said cosmetics application face to a generally opposing edge of said cosmetics application face, and said first and second sets of bristle ends each configured such that they combine to define approximately at least a half sphere, with each of said two sets of bristle ends viewed as generally semicircular when said application end is viewed substantially along said longitudinal axis, such that by applying the brush in a first position obliquely to said flat skin surface, a broadly rounded portion of only one of said first and second set of bristles can be brought into contact with said flat skin surface, and by applying said brush in a second position obliquely to said flat skin surface, a broadly rounded portion of only the other of said first and second set of bristles can be brought into contact with said flat skin surface, and by applying the brush in a third position obliquely to said flat skin surface, the broadly rounded portions of both said first and second set of bristles can be brought into contact with said flat skin surface.

4. The cosmetics brush as claimed in claim 3, wherein said first and second sets of bristles are positioned laterally adjacent to each other in roughly equal halves.

* * * * *